US007516710B2

(12) United States Patent
Kovach et al.

(10) Patent No.: US 7,516,710 B2
(45) **Date of Patent: *Apr. 14, 2009**

(54) APPARATUS FOR AUTOMATED SHADE MANUFACTURING

(75) Inventors: Joseph E. Kovach, Brighton, CO (US); Kevin M. Dann, Denver, CO (US); James M. Anthony, Denver, CO (US); Richard E. Rossi, Thornton, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 41 days.

This patent is subject to a terminal disclaimer.

(21) Appl. No.: 11/615,835

(22) Filed: Dec. 22, 2006

(65) Prior Publication Data

US 2007/0157861 A1 Jul. 12, 2007

Related U.S. Application Data

(60) Provisional application No. 60/758,494, filed on Jan. 12, 2006.

(51) Int. Cl.
*D05B 35/08* (2006.01)
*D05B 23/00* (2006.01)

(52) U.S. Cl. ..... 112/470.12; 112/146

(58) Field of Classification Search ..... 112/144–146, 112/147, 470.33, 470.12, 303, 305, 311, 112/104; 223/38; 29/24.5
See application file for complete search history.

(56) References Cited

U.S. PATENT DOCUMENTS

| | | | | | |
|---|---|---|---|---|---|
| 263,778 | A | * | 9/1882 | Fisher et al. | 112/146 |
| 1,465,938 | A | * | 8/1923 | Guider | 160/344 |
| 1,883,177 | A | * | 10/1932 | Weis | 112/470.12 |
| 1,939,617 | A | * | 12/1933 | Bernhard | 16/87.2 |
| 3,874,311 | A | * | 4/1975 | Kenney | 112/470.12 |
| 4,470,361 | A | * | 9/1984 | Smith | 112/470.12 |
| 4,542,602 | A | * | 9/1985 | Hoverson | 38/102.1 |
| 4,945,969 | A | * | 8/1990 | Schnebly et al. | 160/84.02 |
| 5,769,015 | A | * | 6/1998 | Kato | 112/470.04 |
| 6,530,335 | B1 | | 3/2003 | Halfmann et al. | |

FOREIGN PATENT DOCUMENTS

| | | |
|---|---|---|
| CH | 534 243 | 2/1973 |
| JP | 07 275544 A | 10/1995 |
| JP | 10 137476 A | 5/1998 |
| JP | 2000 303348 A | 10/2000 |
| NL | 1 004 021 C2 | 3/1998 |
| NL | 1 006 408 C2 | 12/1998 |
| WO | WO 90/04079 A1 | 4/1990 |

* cited by examiner

*Primary Examiner*—Ismael Izaguirre
(74) *Attorney, Agent, or Firm*—Dorsey & Whitney LLP

(57) ABSTRACT

An apparatus for stitching a fabric and/or attaching guide rings to the fabric for possible use in a covering for an architectural opening includes a lift bar to which a top edge of the fabric is connected so the fabric can hang into an underlying housing where a plurality of individually operated clamps are positioned. The clamps can manipulate the fabric as the lift bar is raised or lowered while horizontal tucks are formed in the fabric with a reciprocating tucker blade. A pair of traversing sewing machines are used to stitch a tuck and/or attach guide rings to the tuck in an automated operation.

4 Claims, 21 Drawing Sheets

APPARATUS FOR AUTOMATED SHADE MANUFACTURING

CROSS REFERENCE TO RELATED APPLICATION

This application claims priority to U.S. provisional application No. 60/758,494 filed Jan. 12, 2006, and that application is hereby incorporated by reference as if fully disclosed herein.

BACKGROUND OF THE INVENTION

1. Inventive Field

The inventive field relates generally to the automated stitching of fabric and the attachment of rings thereto. In particular, the inventive field relates to the automated stitching and attachment of rings to window coverings such as Roman shades.

2. Background

The attachment of rings to fabrics presently is labor intensive. While automated machinery, such as sewing machines, fabric location and positioning devices and the like have greatly automated the manufacture of fabric based products, such as window coverings, the attachment of rings to such fabrics, e.g., to cooperate with pull cords for operating the coverings, has remained a manual operation. More specifically, when attaching rings to fabrics, such as occurs when manufacturing Roman and similar style window coverings (or "shades"), manufacturers commonly today rely upon manual labor to position the rings and the shade material and then attach the rings to the material using a commercial sewing machine. That is, there are no readily available apparatus or methods for automatically positioning the fabric (relative to a ring adapted sewing machine) and repeatedly attaching rings thereto. Thus, a need exists for an apparatus and method for the automated attachment of rings to fabric as well as pre-stitching the fabric and, more specifically, the automated manufacture of Roman shades and other window coverings.

SUMMARY OF THE INVENTION

The apparatus of the present invention includes a lift bar for attachment to the top edge of a fabric material to be treated with the apparatus of the invention and a plurality of clamps within an underlying housing for manipulating the fabric during stitching and ring-attachment operations.

By properly gripping and manipulating the fabric, a pair of sewing machines can sequentially traverse the width of the fabric to stitch the fabric and/or attach rings to the fabric for use as cord guides when the fabric is incorporated into a control system for a window covering or the like.

Other aspects, features and details of the present invention can be more completely understood by reference to the following detailed description of a preferred embodiment, taken in conjunction with the drawings and from the appended claims.

DESCRIPTION OF THE DRAWING FIGURES

DETAILED DESCRIPTION

An apparatus and method is provided for stitching and automatically attaching rings to fabric and other materials (hereafter, collectively "fabrics"). It is to be appreciated the apparatus may be utilized to attach rings, buttons, loops, and other types of objects (hereafter, collectively, "rings") to fabrics. The apparatus and method further provides for the stitching of a seam in fabric. Based upon various combinations of rings and seams, the apparatus can produce at least four different types of window coverings: (1) rings only, where rings are attached but a seam is not sewn coincident with the rings; (2) slouched, where at least two rings are attached and a seam sewn so that the fabric may slouch between the rings; (3) reverse fold shades, where a plurality of rings are attached and a seam is sewn so as to create a tunnel that can be stiffened by a rod or otherwise; and (4) hobbled shades, with either tapes or sheets being utilized to create the hobble. Window coverings bearing rings are often commonly identified as "Roman Shades," but, it is to be appreciated the apparatus and methods disclosed herein need not be construed or limited to the production of only Roman Shades. The apparatus and methods may be used to attach rings to any type of fabrics, with or without seams being stitched too.

Figure 1:
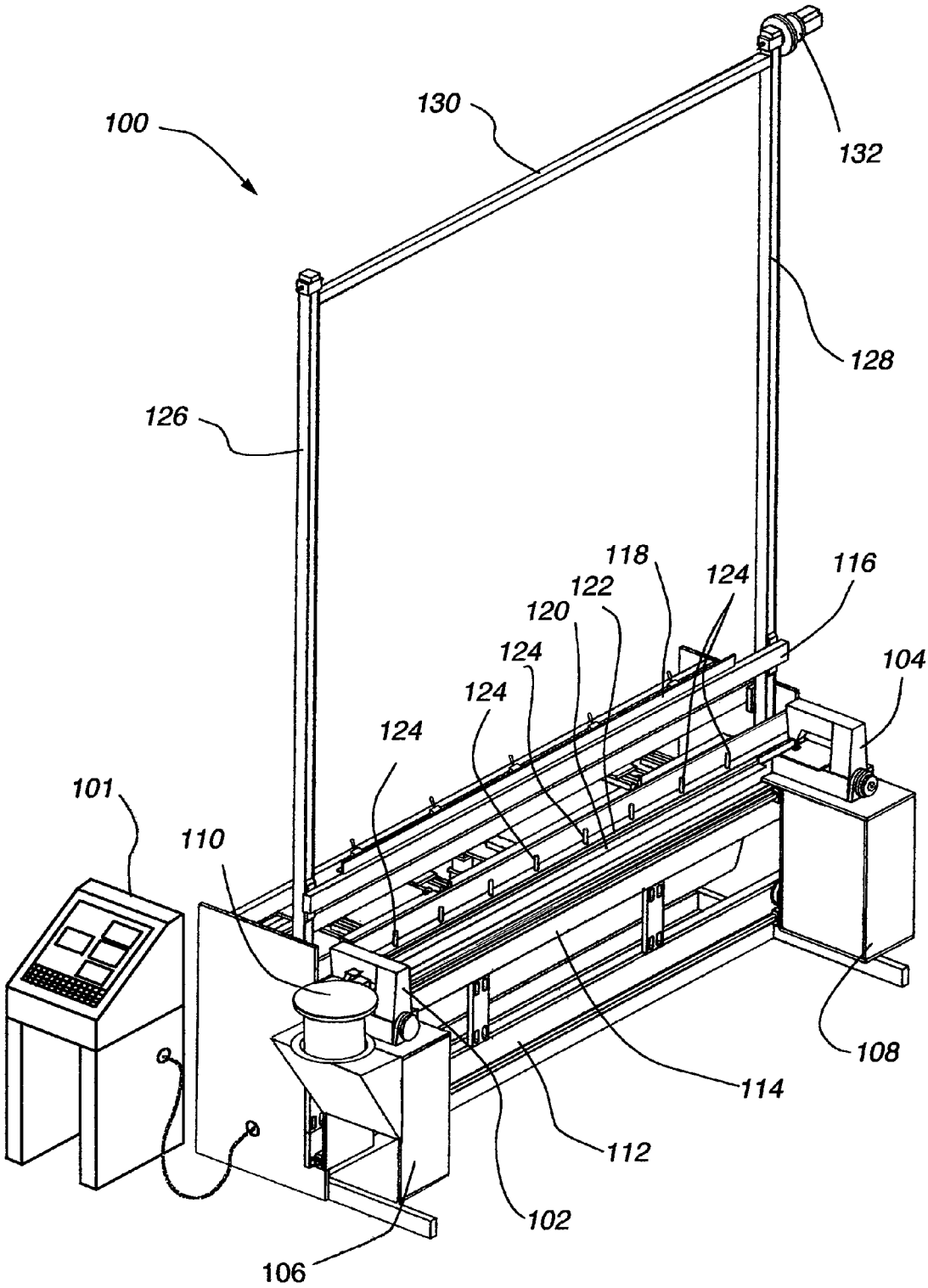
FIG. 1 is a front perspective view of an apparatus used to automatically attach rings to fabric.
Figure 3A:
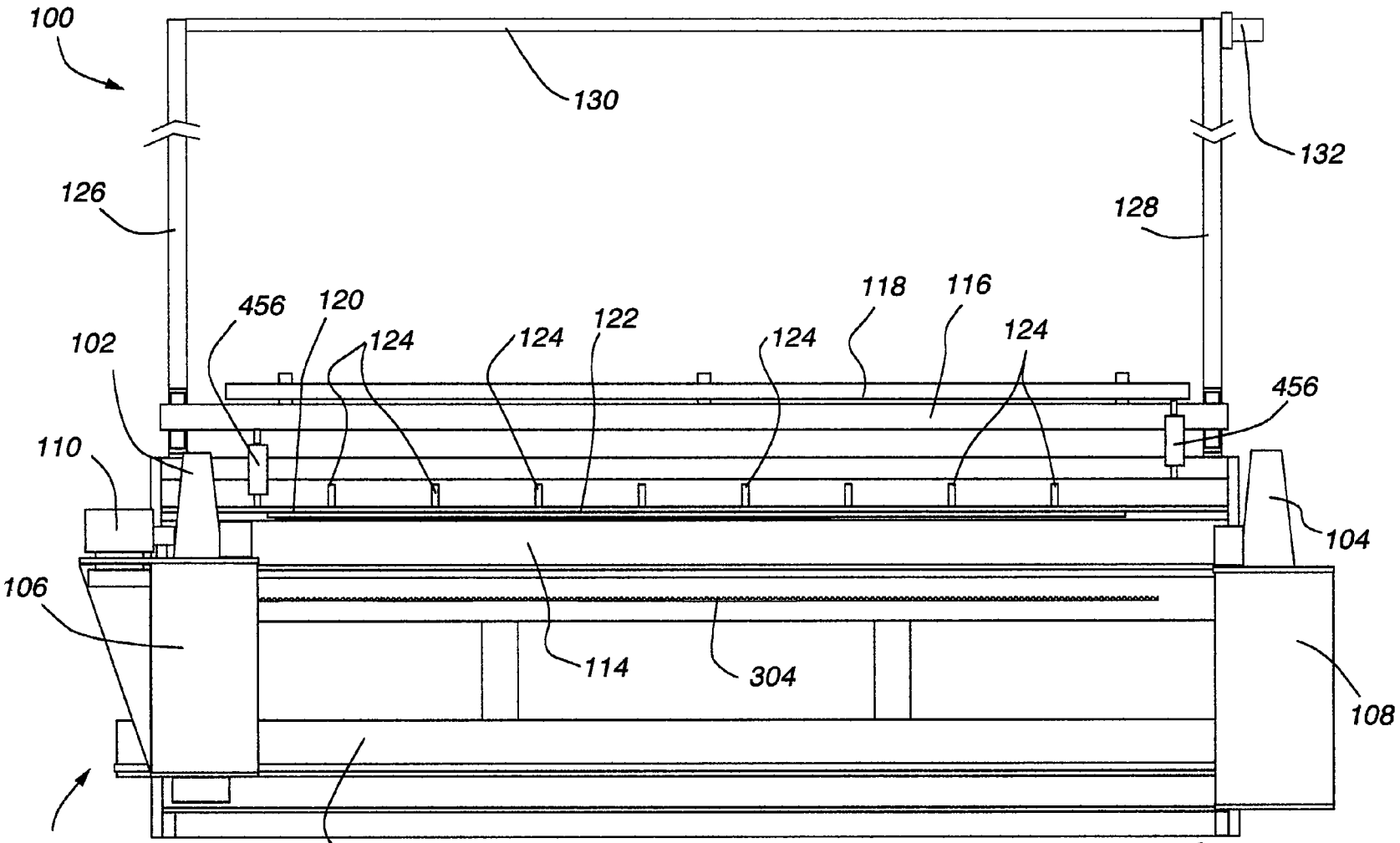
FIG. 3A is a front view of the apparatus shown in FIG. 1.

As shown in FIGS. 1 and 3A, the apparatus 100 includes an operator's control console 101, a first sewing machine 102, a second sewing machine 104, a first sewing housing 106, a second sewing housing 108, a ring hopper 110, a first guide rail 112, a second guide rail 114, a lift bar 116, a top clamp 118, a tucker 120, a sewing clamp 122, a plurality of sewing clamp activators 124, a left guide rail 126, a right guide rail 128, a top cross-member 130, and a lift motor assembly 132.

Figure 2A:
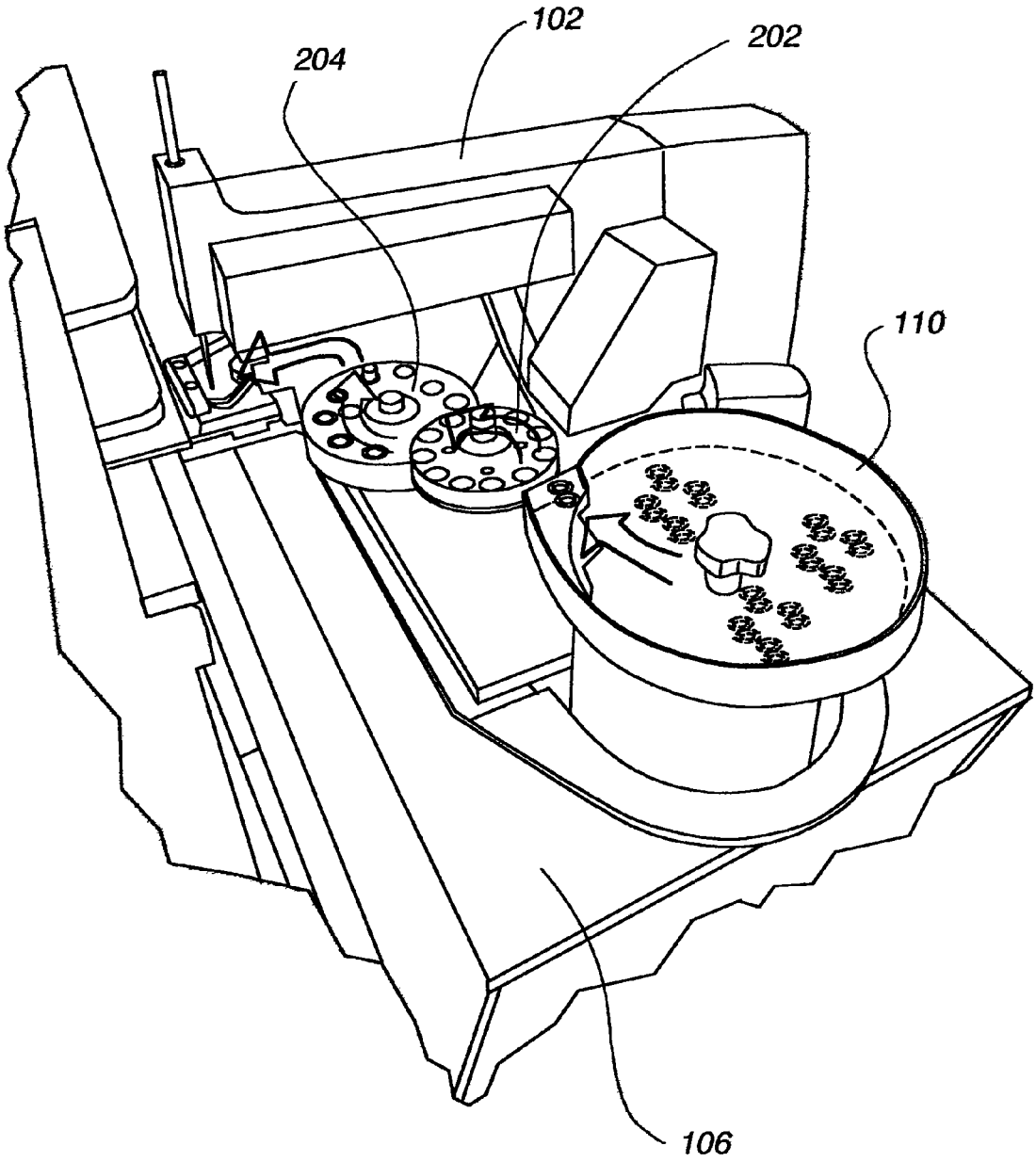
FIG. 2A is perspective view of a ring feeding mechanism utilized in conjunction a first sewing machine on the apparatus shown in FIG. 1.
Figure 2B:
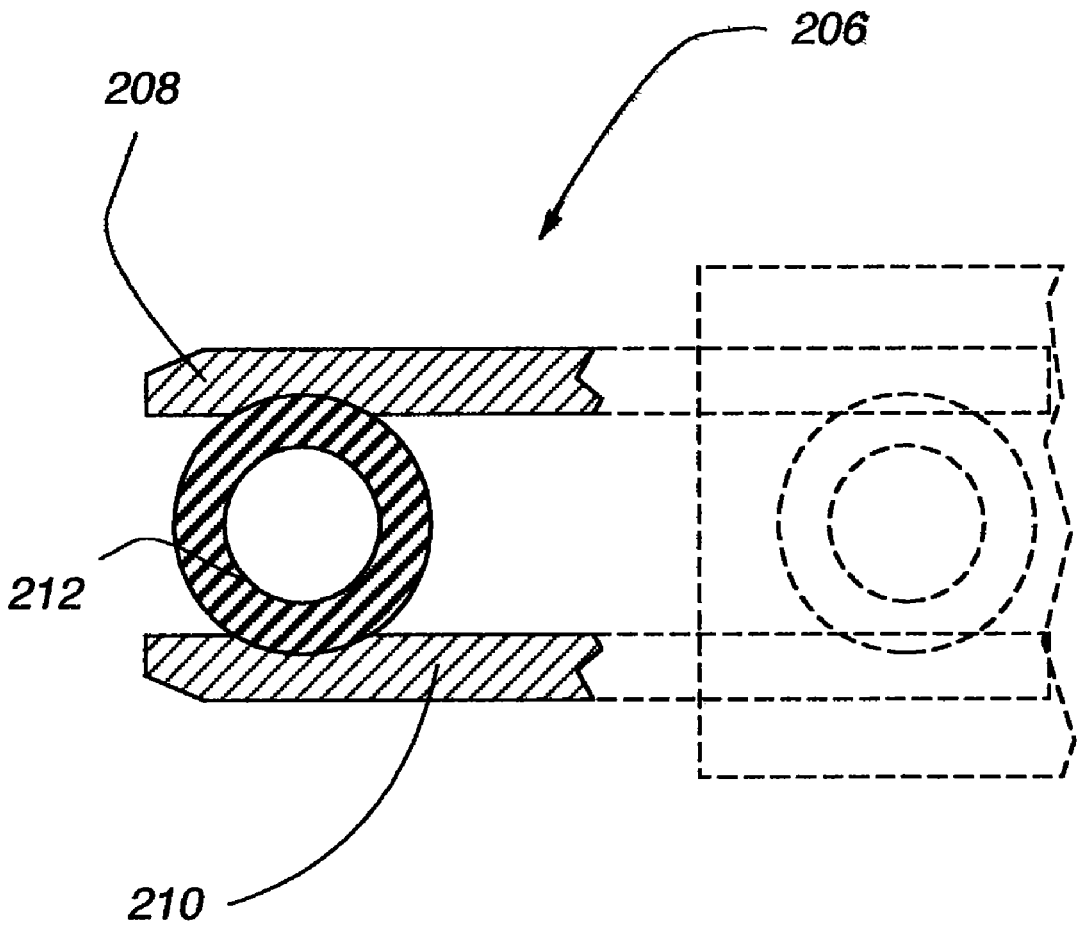
FIG. 2B is a top view of a clamping assembly utilized in conjunction with the ring feeding mechanism of FIG. 2A.

As further shown in FIG. 2A, the first sewing machine 102 is mounted on the first sewing housing 106 and desirably includes a sewing machine and apparatus configured to sew a ring to fabric. For example, an MB1800 AM/BR 10 sewing machine and apparatus, as manufactured by Juki Corp. located in Tokyo, Japan (hereafter, the "first sewing machine") can be used. Other sewing machines adapted to attach rings to fabric can also be utilized for other embodiments. The first sewing machine commonly includes a ring hopper 110 configured to store a plurality of rings and dispense rings into a first carousel 202. The first carousel 202 is adapted to rotate and dispense rings into a second carousel 204 and then into a ring clamping assembly 206, as shown in FIG. 2B. More specifically, the ring clamping assembly 206 includes a first tong 208 and a second tong 210 that when pressed towards each other can clamp and retain a ring 212 therebetween.

The apparatus 100 (FIG. 1) can also include, for certain embodiments, a second sewing machine 104 and associated second housing 108. The second sewing machine 104 can be configured to sew a seam, cross-stitch, or the like along an entire width, or portion thereof, of fabric in a horizontal direction. For one embodiment, the second sewing machine is a DDL-8700 tunnel stitching machine which is also manufactured by Juki Corporation. Other types of stitching machines can be utilized in other embodiments. Also, the apparatus 100 may be configured to include and/or utilize, for any given task, only one sewing machine. That is, the apparatus may be configured to include and/or utilize only the first sewing machine 104, only the second sewing machine 104, both the first and second sewing machines 102 and 104, more than two sewing machines or the like. That is, a sewing machine can be provided, for example, that is adapted to sew rings as well as stitch seams. Thus, while two sewing machines are shown in FIG. 1 for the apparatus 100 shown therein, any number of sewing machines can be used.

As shown in FIG. 3A, when the apparatus 100 is in a rest state, such as may occur for maintenance, when the apparatus 100 is being programmed, when fabric is being loaded onto or from the apparatus 100, or when rings are not to be sewn to the fabric, the first sewing machine 102 and associated housing 104 is desirably positioned at a home position 300. As shown in FIG. 3A, the home position for the first sewing machine in this embodiment is at a far left position. The home position, however, can be positioned anywhere along the apparatus, but, is desirably positioned such that the second sewing machine 104 (when present) can access the full width of any loaded fabric without interference from the first sewing machine 102. Likewise, the second sewing machine 104 and associated housing 107 can be positioned at a far right home position 310. Each sewing machine and housing can be desirably positioned so that either sewing machine may travel across the available stitching span 300 of the apparatus. In one embodiment, the span 300 facilitates the sewing of rings to and stitching of fabrics up to 96 inches in width. However, longer and shorter fabric widths may be supported.

Figure 3B:
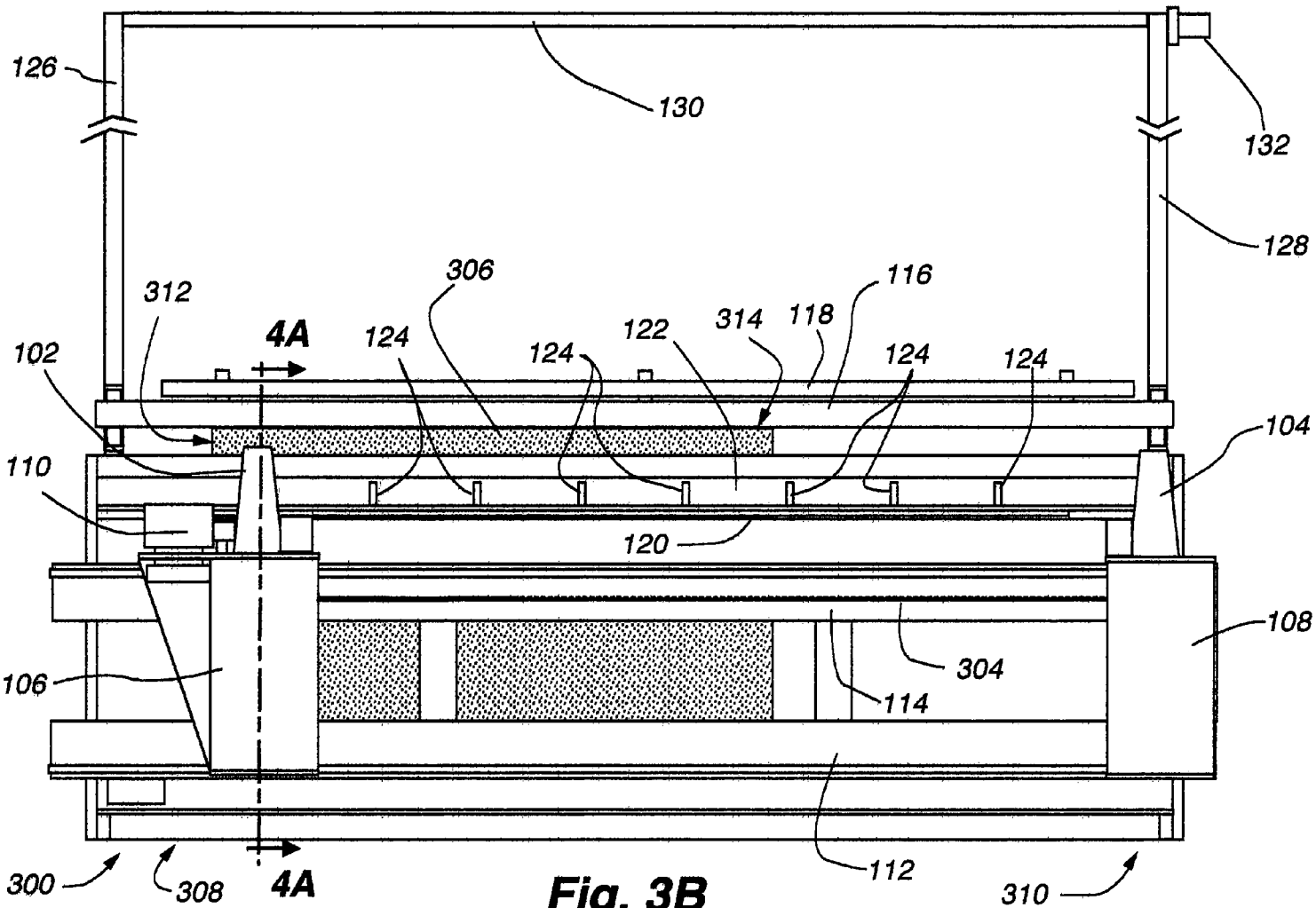
FIG. 3B is a front view of the apparatus shown in FIG. 1 and further shows the positioning of a fabric material prior to the attachment of rings thereto.

FIG. 3B illustrates the operation of the apparatus when the first sewing machine 102 is in a first ring attachment position 308. As shown, a fabric 306 has been loaded into the machine and secured to the lift bar 116 by the top clamp 118. In one embodiment, the apparatus is desirably loaded such that the bottom of the fabric (when being used to hang as a window covering from a framing member at the top of a window) is secured to the lift bar 116. For other embodiments, however, the top, bottom or any location therebetween may be secured to the lift bar 116.

Figure 3C:
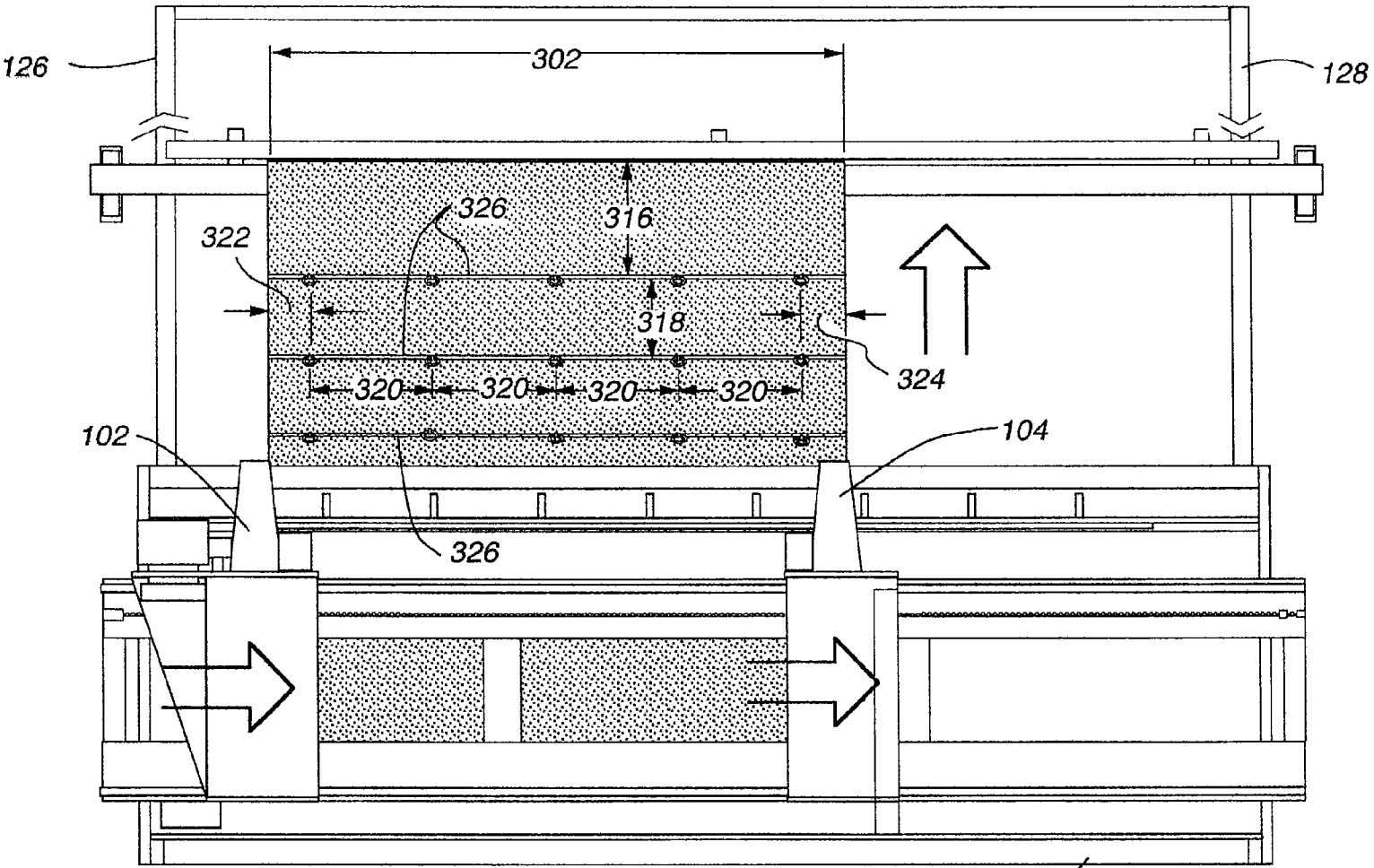
FIG. 3C is a front view of the apparatus shown in FIG. 1 and further shows the positioning of a fabric material to which a plurality of rings and seams for tunnels and/or hobbles have been attached.

As further shown in FIGS. 3B and 3C, the first ring attachment position can be located a given offset 322 to the right of the left edge 312 of the fabric 306. In one embodiment, the offset is one inch. Desirably, each row of rings has at least two rings, with the first and second rings each being attached the same offset (322 and 324) from the left edge 312 and the right edge 314, respectively, of the fabric 306. When more than two rings are to be attached to the fabric 306, the apparatus suitably determines where to position the third, fourth, and subsequent rings based upon the fabric width, the desired gap (320) between rings, and the total offset (i.e., the combined left and right offsets). Based upon these parameters, which an operator may input or the apparatus may be configured to automatically determine based upon fabric type, weight and/or width and the number of rings necessary per row, the positions for such rings are determined. For example, a fabric 92 inches wide, with 1 inch left and right offsets and a desired gap 320 (FIG. 3C) of no more than 9 inches results in 10 rings being attached to the fabric at the following positions: 1, 11, 21, 31, 41, 51, 61, 71, 81 and 91 inches to the right of the left edge 312 of the fabric 306.

Similarly, the apparatus can be configured to attach rows of rings (and/or sew seams) at a predetermined interval along the length of the fabric 306. That is, the lift bar 116 may be positioned by the lift motor assembly 132 such that a given vertical gap 316 exists from the lift bar 116 to the first row of rings and/or seams. Likewise, the vertical gap 318 between rows of buttons can also be predetermined and/or specified real-time by an operator. Like the variable horizontal gaps 320, the vertical gap 316 between rows of rings can be constant or vary along the length of the fabric, as desired for specific aesthetic or functional needs. The vertical gaps 316 and 318 can be predetermined and/or specified real-time by an operator. In one embodiment, the vertical gap between rows is 7 inches.

For one embodiment of the apparatus, the lift bar 116, top clamp 118, left and right guide rails 126 and 128, and top cross-member 130 are provided and manufactured by Thompson of Amherst, N.Y., USA. Other apparatus and devices for suspending, raising and lowering fabrics can be utilized in other embodiments of the apparatus.

The length of fabric which can be suspended from the lift bar 116 can also vary based upon a particular embodiment of the apparatus used. In one embodiment, the length of fabric is determined based upon the length of the left and right guide rails 126 and 128. In other embodiments, the length of fabric supported can depend upon the type of clamping mechanism utilized as the top clamp 118. For example, a top clamp 1 18 configured to not support the hanging of fabric by other than its ends can limit the fabric length to the length of the guide rails 126 and 128. In contrast, a top clamp 118 configured to support the wrapping of fabric over the top rail, such that fabric extends from either side of the lift bar 116 can support fabric lengths longer than the length of the guide rails 126 and 128. Thus, it is to be appreciated that various types of top clamps, lift bars, guide rails and the like may be used to suspend a fabric for use in the apparatus. Alternatively, the fabric may be suspended horizontally or at some angle between horizontal and vertical. That is, the guide rails can be rotated until they are horizontal with the tucker and thereby support the attaching of rings and seam sewing of fabrics of various lengths.

Figure 6:
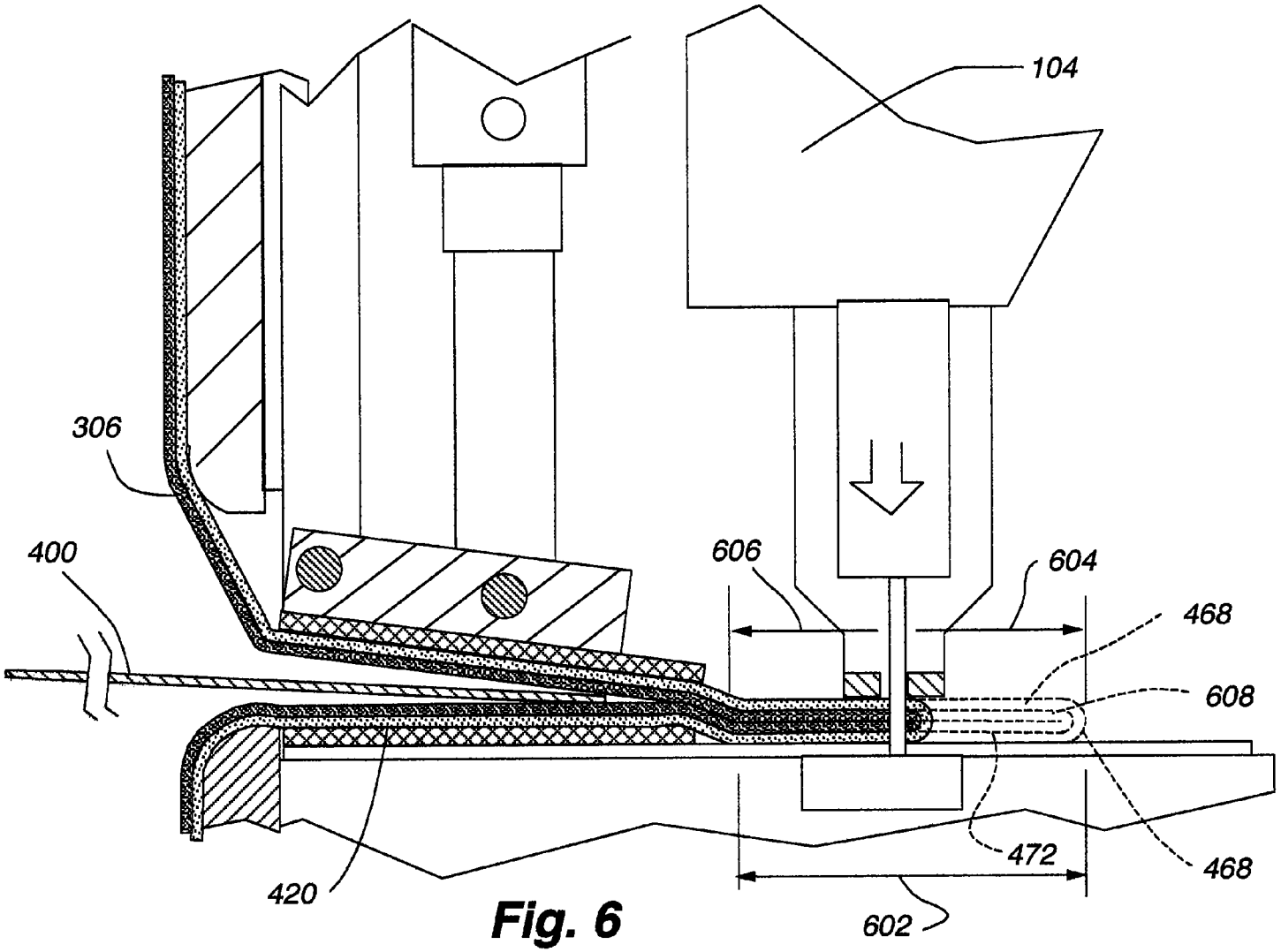
FIG. 6 is a close-up sectional view of tunnel stitching machine for use in another embodiment of the apparatus shown in FIG. 1.

As further shown in FIGS. 3A and 3B and as mentioned above, the apparatus can be utilized to sew one or more seams in the fabric. When sewing seams, the second sewing machine can be desirably positioned and/or travel along the span 302 of the fabric to sew seams of any given length and thickness. In one embodiment, seams are sewed parallel with a given horizontal row of rings. However, it is to be appreciated that horizontal seams can be sewn with or without a corresponding row of rings. As shown in FIG. 6, a seam can be sewn within a given range of overlap, wherein the range of overlap determines the amount of material extending beyond the seam, as shown by line 604. It is to be appreciated that as the needle is positioned further along line 606, a larger overlap occurs. Likewise, as the needle is positioned further along line 604, a smaller overlap occurs. Thus, by varying the location of the needles, with respect to a given seam, the size of the tunnel 608 created by the stitching of the seam can be varied. A larger tunnel enabling a thicker rod or dowel to be inserted therein, and thereby a stiffer shade, horizontally, can be provided. It is to be appreciated that the stiffer the shade, horizontally, the more uniformly the shade can be raised and lowered.

Figure 4A:
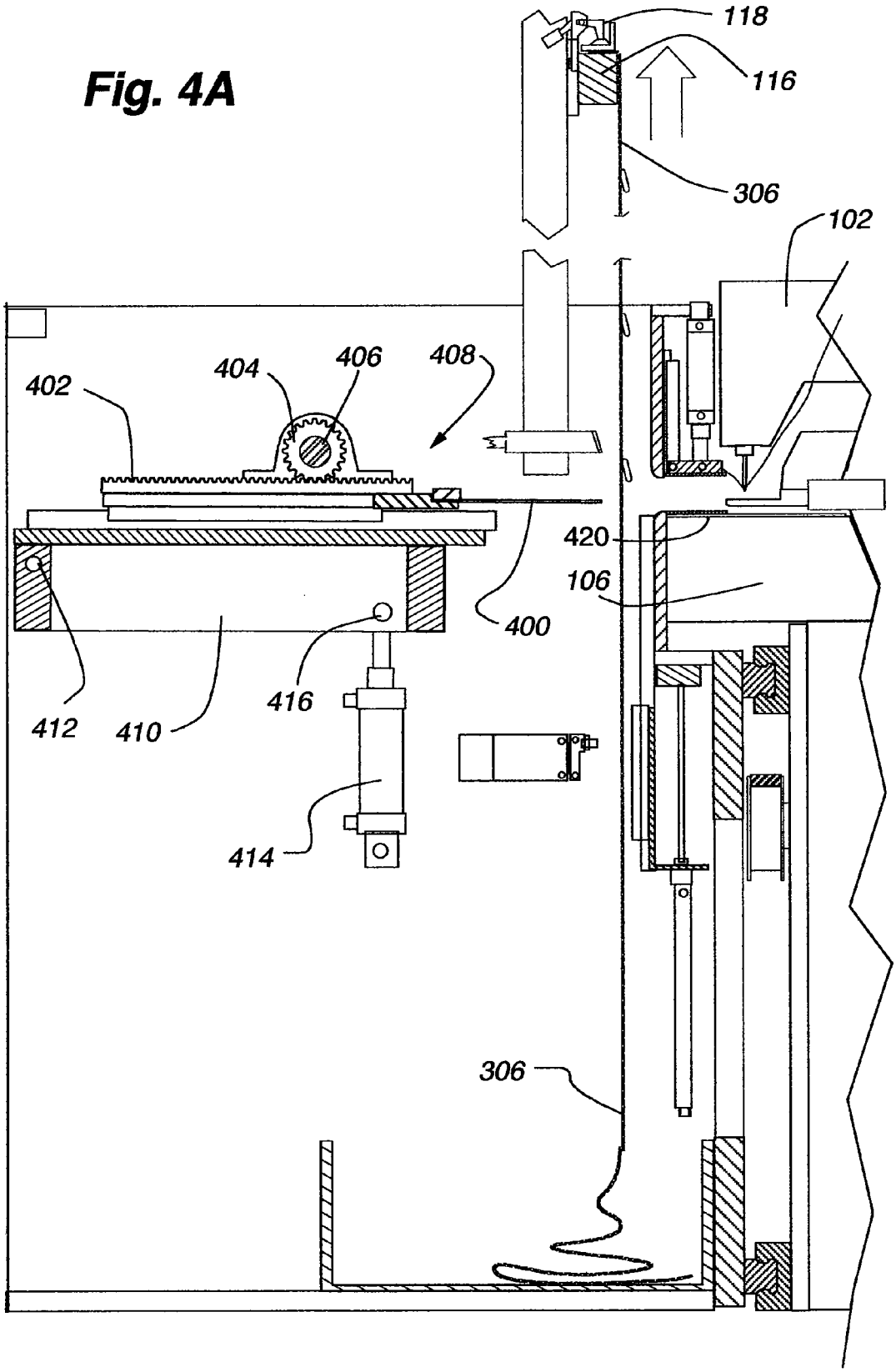
FIG. 4A is a cross-sectional view taken along line 4A of FIG. 3B which shows the ring attachment station of the apparatus of FIG. 1 prior to the fabric being vertically clamped and tucked.

Referring now to FIG. 4A, the apparatus 100 is shown in a rest position, i.e., a state between the sewing of a next row of rings to the fabric and/or the stitching of a next seam to the fabric. The apparatus 100 includes a tucker blade 400. As discussed below, the tucker blade 400 is utilized to press the fabric 306 towards a needle of the sewing machines 102 and 104. As shown in FIG. 4A, the first sewing machine 102 is positioned in a ready state to attach a next row of rings to the fabric 306. It is to be appreciated, however, that the second sewing machine 104 can also be similarly positioned. In one embodiment, the tucker blade 400 is Teflon® coated on both its top and bottom surfaces. Other coatings, if any, can be used to obtain a given level of friction between the blade and the fabric. The tucker blade 400 is suitably attached to a gear rack 402, which is in communication with a pinion gear 404, that can be driven by the shaft 406 of a motor (not shown). As the shaft 406 of the motor is rotated in a clockwise direction (as shown by arrow 408) the tucker blade 400 is retracted (moved away) from the suspended fabric 306. Likewise, when the shaft is rotated in a counter-clock-wise direction, the tucker blade 400 is extended towards the suspended fabric 306 (as shown in FIG. 4D). The tucker blade 400, gear rack 402, pinion gear 404 and motor are positioned on a support assembly 410 which is attached at a pivot point 412 to a frame member of the apparatus 100. The support assembly 410 is also pivotally attached, at pivot pin 416, to an angle adjustment mechanism, actuator 414, which is configured to pivot the support assembly 410 about the pivot point 412 such that the angle at which the tucker blade 400 impinges the fabric 306 can be varied. In one embodiment, the actuator 414 includes a pneumatic piston and related compressors and control mechanisms. In other embodiments, hydraulic pistons, motor driven chain (or belt) and pulley mechanisms or the like may be utilized to adjust the angle of the tucker blade 400. Further, it is to be appreciated that the height, angle and/or other orientations of the tucker blade 400 may be suitably controlled using other well known structures such as height and/or angle adjustable tilt tables and the like.

Figure 4B:
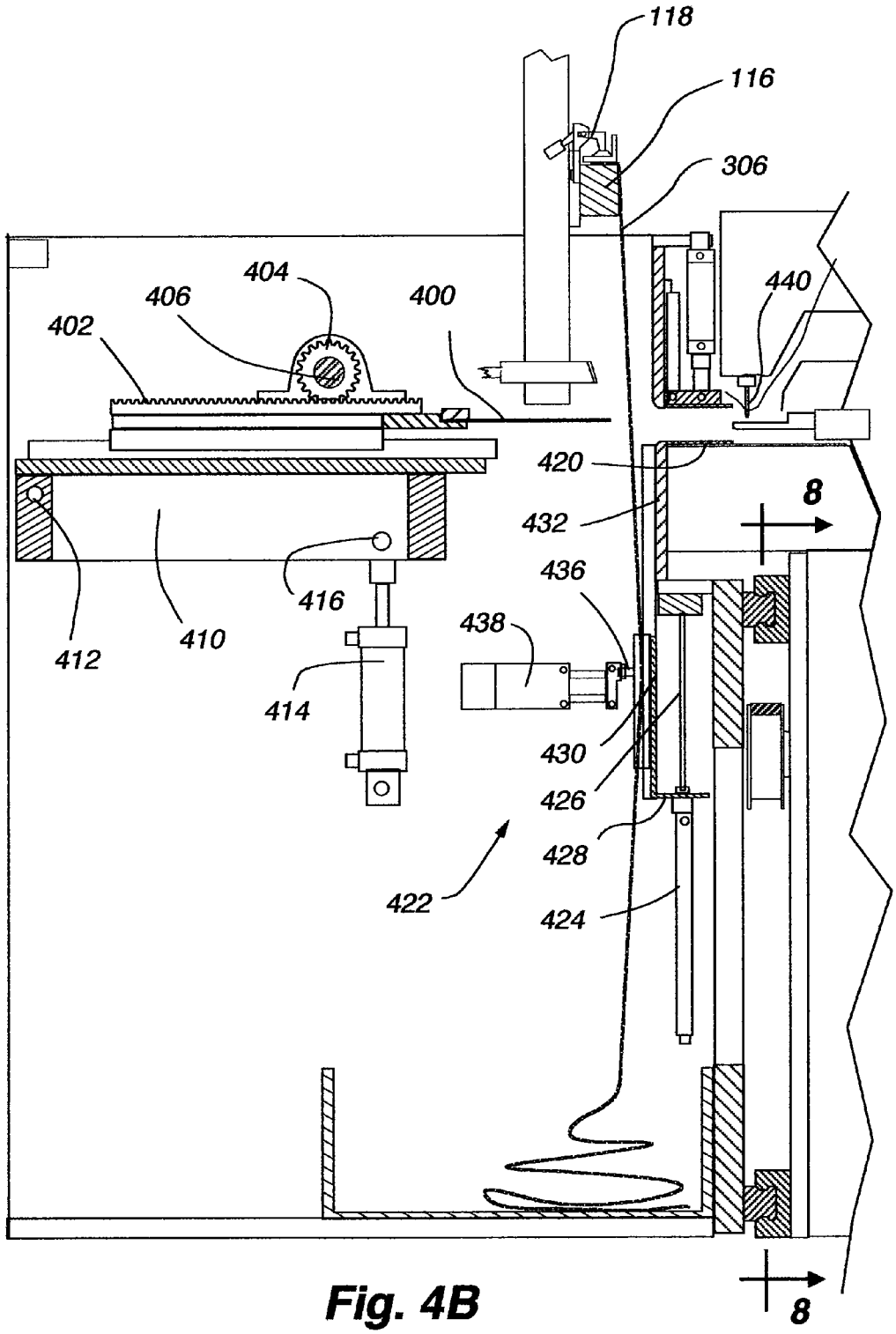
FIG. 4B is a cross-sectional view taken along line 4A of FIG. 3B which shows the ring attachment station of the apparatus of FIG. 1 with the fabric vertically clamped and awaiting tucking.

As shown in FIG. 4B, the apparatus 100 includes a tensioning mechanism 422 that is utilized to apply tension to the fabric as it is being raised. It is to be appreciated that as the relative height of the lift bar 116 (and the fabric attached thereto) increases, the remaining portion of the fabric below the height of the tucker blade 400 decreases. This decrease in fabric correspondingly results in a decrease in the weight of the fabric and the tension applied to the tucker blade 400 by the fabric. As a result, without a tensioning mechanism, a variable amount of fabric can be impinged by the tucker blade 400 when it is extended. To prevent this variability, the tensioning mechanism 422 is configured to provide uniform tension to the fabric 306 while it is initially impinged by the tucker blade 400.

In the embodiments shown in FIG. 4B, the tensioning mechanism 422 includes a pneumatic piston 424 providing a given amount of resistance to a connecting rod 426. The connecting rod 426 is connected to an offset bracket 428. The offset bracket 428 is connected to a linear bearing 430. The linear bearing 430 is also connected to a mounting bracket 432. The fabric side of the linear bearing 430 (i.e., the side of the linear bearing coming into contact with the fabric) desirably is coated with an adhesive tape or other moderate to high friction surface, such as Bobotex Friction Covering manufactured by Bobtex Hans Ludwig GmbH & Co. of Wuppertal, Germany, so as to provide positive contact with the fabric when desired. It is to be appreciated that a friction plate or other member can also be attached to the fabric side of the linear bearing in order to provide any desired friction. The tensioning mechanism 422 also includes a corresponding pressure bar assembly 434. The pressure bar assembly 434 desirably provides a force that is opposed by the linear bearing 430 such that the fabric 306 can be impinged between the pressure bar 436 (when extended) and the linear bearing 430. The pressure bar 436 is attached to at least one adjustable and controllable actuator 438. In one embodiment, the actuator 438 includes one or more pneumatic pistons. Other types of actuators, however, can be used in other embodiments of the apparatus. Thus, it is to be appreciated that when in operation, the tensioning mechanism 422 provides a given and consistent amount of tension to the fabric whenever the tucker blade 400 is to be extended, such that a consistent "tuck" of the fabric is achieved.

As shown in FIG. 4D, while the tucker blade 400 is moved toward the fabric 306, the blade 400 travels at a substantially level orientation and thereby creates a "V" in the fabric. Likewise, as the tucker blade 400 impinges and pushes the fabric 306 towards the sewing positions (as represented by needle 440) the linear bearing 430 and corresponding pressure bar assembly 434 move upwards, while the piston 424 provides the desired downward resistance on this assembly and the impinged thereby fabric. Further, the tensioning mechanism 422 can apply pressure to any number of layers of fabric. For example, when multiple sheets of fabric are used in a shade, the fabric can be positioned relative to the tensioning mechanism, and specifically relative to the pressure bar assembly, such that downward pressure can be applied to one sheet, all sheets or any number of sheets of fabric.

Figure 4C:
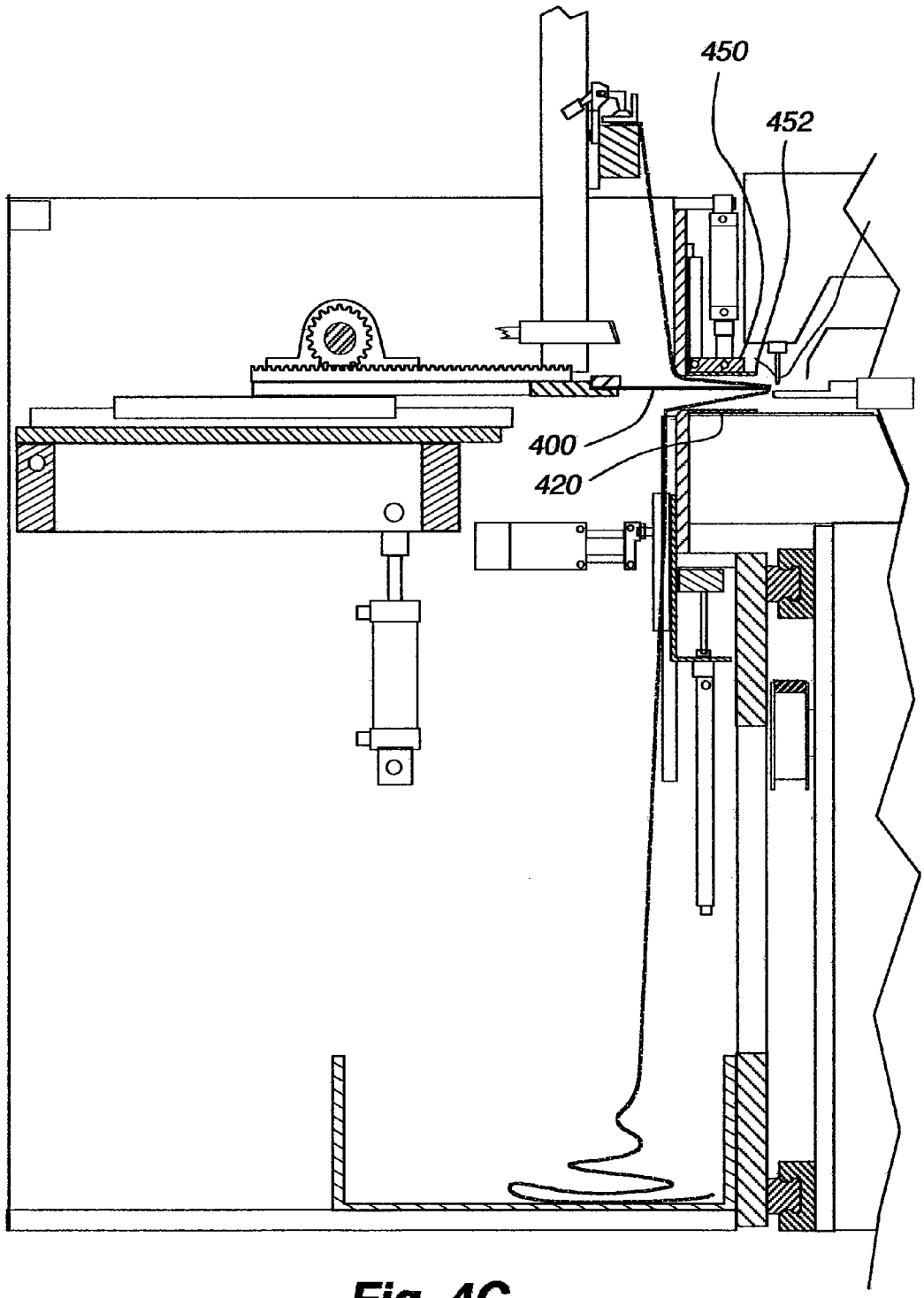
FIG. 4C is a cross-sectional view taken along line 4A of FIG. 3B which shows the ring attachment station of the apparatus of FIG. 1 with the fabric vertically clamped and tucked.
Figure 4D:
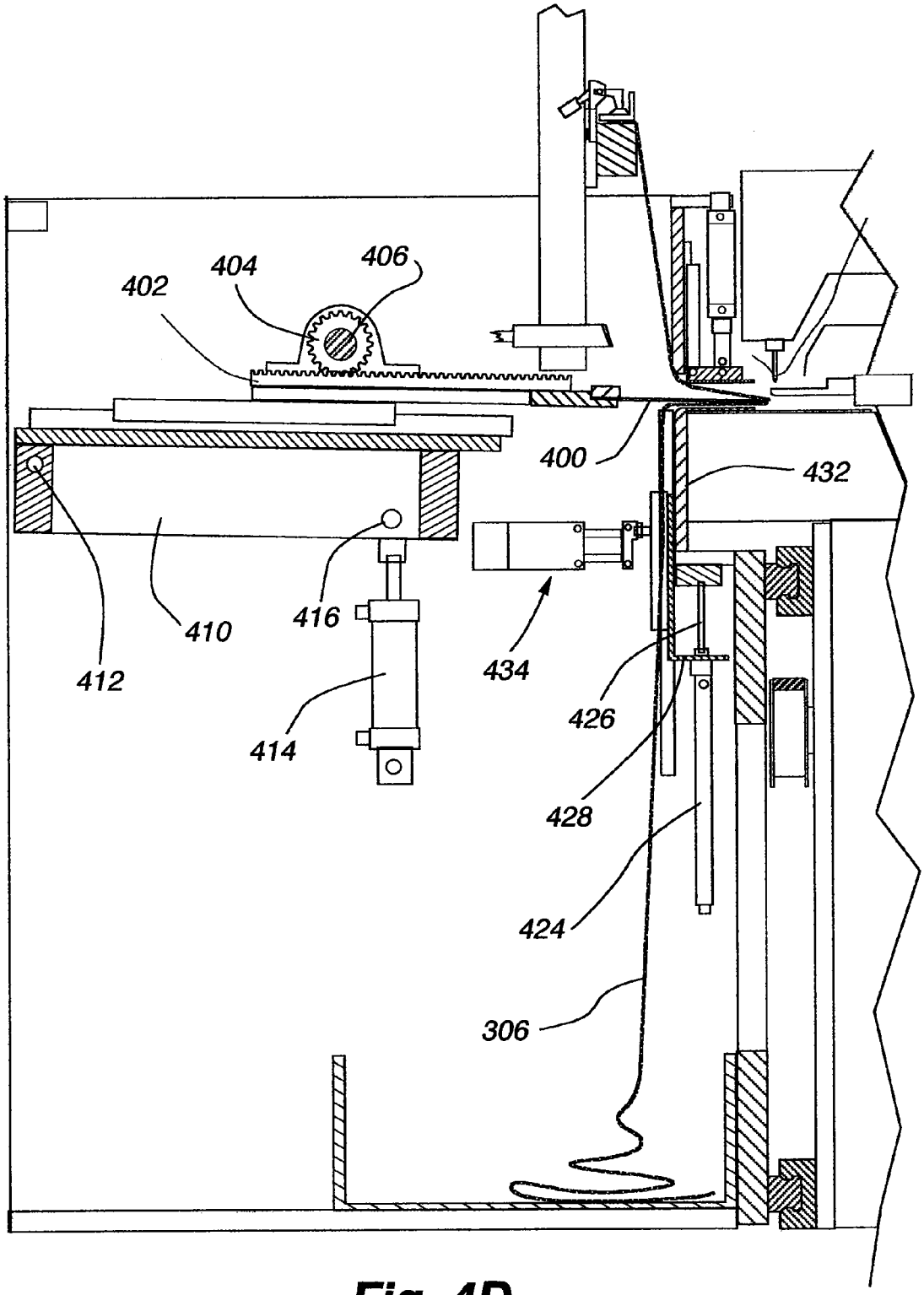
FIG. 4D is a cross-sectional view taken along line 4A of FIG. 3B which shows the ring attachment station of the apparatus of FIG. 1 with the fabric vertically clamped, tucked, and horizontally clamped.
Figure 4E:
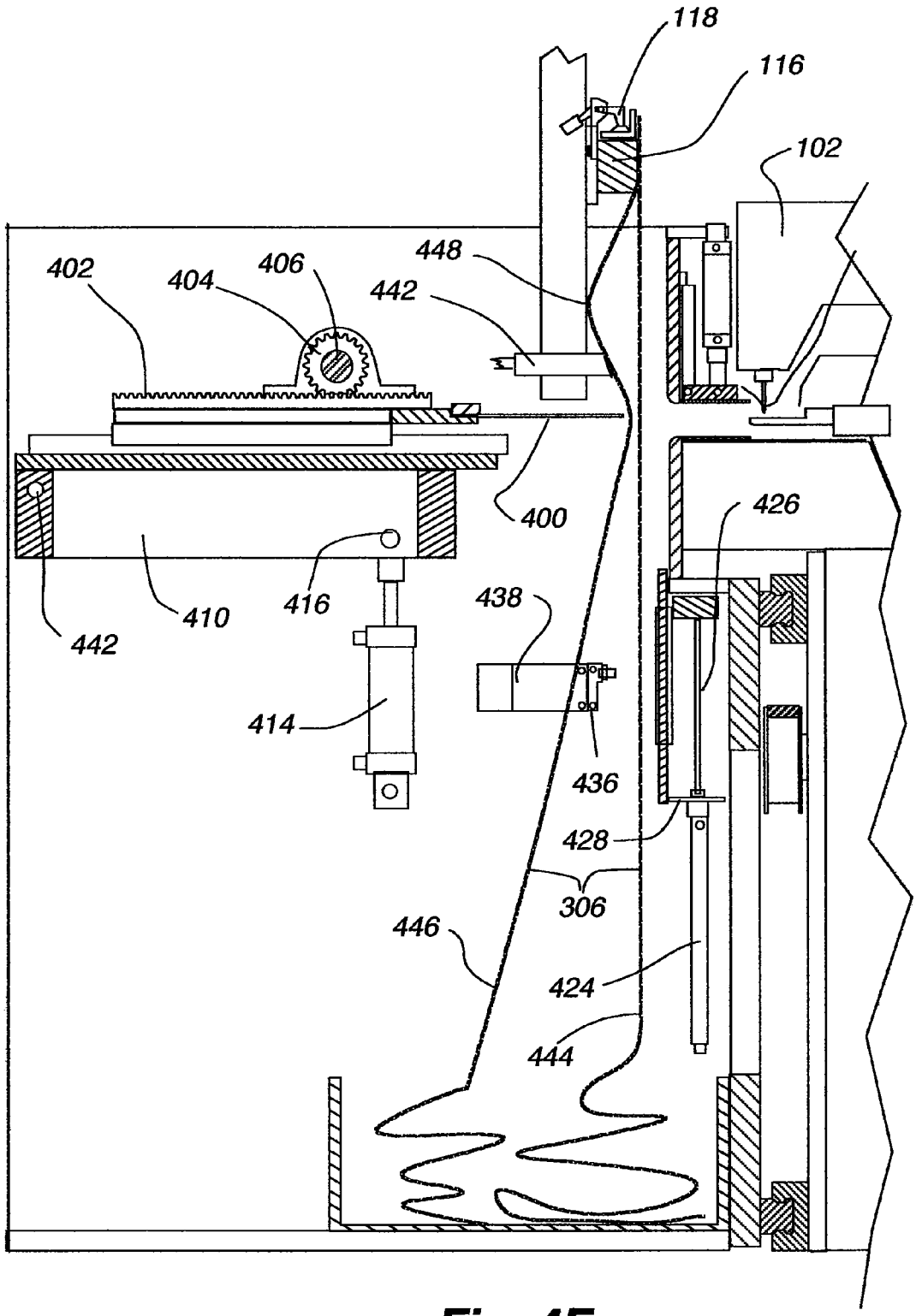
FIG. 4E is a cross-sectional view taken along line 4A of FIG. 3B which shows the ring attachment station of the apparatus of FIG. 1 after activation of a vacuum plenum so as to bunch a front sheet of fabric and prior to vertical clamping of a back sheet of fabric, as used for one application of the apparatus to create a hobbled roman shade.

Further, when a hobbled shade look is desired, the apparatus can be configured such that downward pressure is applied only to one or more backing panels 444 and not to a front panel 446 thereby allowing a bulge 448 to be created in the front panel 446. Further, when a hobbled shade look is desired, as shown in FIG. 4E, a vacuum plenum 442 can be utilized to suction the front panel 446 away from direct contact with the back panel 444 and thereby facilitate the formation of a consistent bulge 448.

The apparatus can also be configured to rotate the tucker blade 400 down once a "tuck" of the one or more panels of fabric has been achieved. As shown in FIG. 4C, the support assembly and tucker components affixed thereto (i.e., blade 400, gear rack 402, pinion gear 404, motor (not shown) and the like) are tilted clockwise about pivot point 412 by a release in the pneumatic pressure of actuator 414. That is, the actuator 414 rotates the tucker blade 400 downwards such that a bottom portion of the "V" in the fabric comes into direct contact, under pressure, with the top surface of ledge 420. It is to be appreciated that by tilting the tucker blade 400 a pressure point instead of a pressure plane is created between the tucker blade 400, the fabric 306 and the corresponding ledge 420 in the "V" area 418. The resulting pressure point resulting in less friction between the tucker blade 400 and the fabric 306 and thereby facilitating the smooth (non-fabric snagging) retraction of the tucker blade 400.

As shown in FIG. 4C, the apparatus 100 also includes a horizontal clamp 450 and attached pressure plate 452 that are utilized to provide a downward force upon the "V" portion of the fabric 418 during ring attachment and/or stitching operations.

Figure 5:
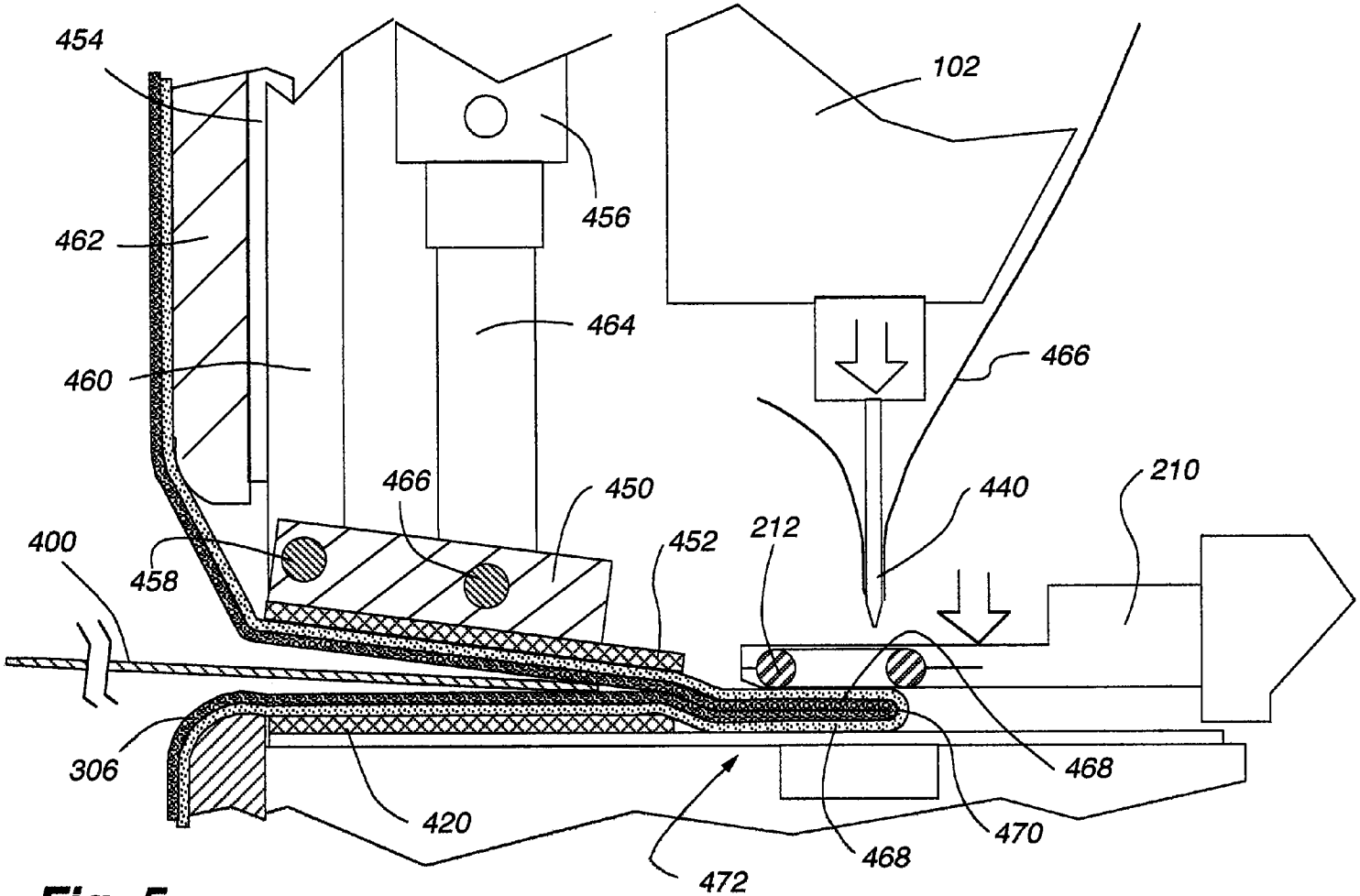
FIG. 5 is a close-up sectional view of the ring attachment station, in a ready to sew position, for the apparatus shown in FIG. 1.

In FIG. 5, a close-up view of the sewing clamp 122 (see FIG. 1) and sewing clamp activators 124 (FIG. 1) for one particular embodiment of the apparatus are shown. Particularly, sewing clamp 122 includes a horizontal clamp 450, connected to vertical member 460 at pivot point 458. The vertical member 460 is connected to a linear bearing 454, which is fastened to a frame member 462. The linear bearing 454 facilitates the vertical movement of the vertical member 460 over a predetermined range. Also, the horizontal clamp 450 is connected at pivot point 466 to sewing clamp actuator (124, FIG. 1) such as pneumatic piston 456 via rod 464.

When under force from rod 464 being extended from piston 456, the horizontal clamp 450 applies pressure, via pressure plate 452, to the tip end of "V" portion of the fabric 306. As shown, upon the pressure plate 452 applying pressure to the fabric 306, beyond the tip of the "V" (i.e., to the right on the drawing figure), a top segment 468 of the fabric before the fold 470 is pressed into contact with a bottom segment 472 of the fabric. More specifically, the extension of rod 464 results in: the downward travel of vertical member 460 along the track of linear bearing 454, the rotation of horizontal clamp 450 about pivot point 458, and thereby applies point pressure, via pressure plate 452, to the fabric 306. Further, it is to be appreciated that the tucker blade 400 (as shown in FIG. 4E) can be fully or partially retracted from the "V" region of the fabric as the rod 464 is extended and the pressure upon the fabric 306 is transferred from the tucker blade 400 to the pressure plate 452. When partially retracted, as shown in FIG. 4E, the tucker blade 400 can also apply pressure to the fabric at the bottom of the "V." Once the top segment 468 and bottom segment 472 of the fabric 306 have been pressed into contact with each other, the fabric 306 is ready to have a seam stitched and/or a plurality of rings sewn thereon. It is to be appreciated that for the embodiment of the apparatus shown in FIG. 1 and discussed hereinabove the fold exists along the entire width of the fabric 306.

Referring now to FIGS. 3C and 6, when a seam is to be stitched and after the fabric 306 has been tucked, pressed and a fold thereby formed (as discussed above with respect to FIG. 5 and as shown in FIG. 6), the second sewing machine 104 is desirably positioned at a stitching start position 328 (FIG. 3C). The second sewing machine 104 then proceeds along the width of the fabric while stitching a seam, such as seam 326. As discussed above, the seam may be positioned a variable distance from the fold 470 and thereby create a tunnel 608 in the fabric. Additionally, the seam may be stitched across the entire width, or a portion of, the fabric.

Following the stitching of a seam, if any, for a given row on the fabric, the second sewing machine 104 is returned to its home position 310 (FIG. 3B) and the attachment of one or more rings commences with the first sewing machine 102 being moved from its home position 300 (FIG. 3A) to the first ring position 308 (FIG. 3B).

Figure 7A:
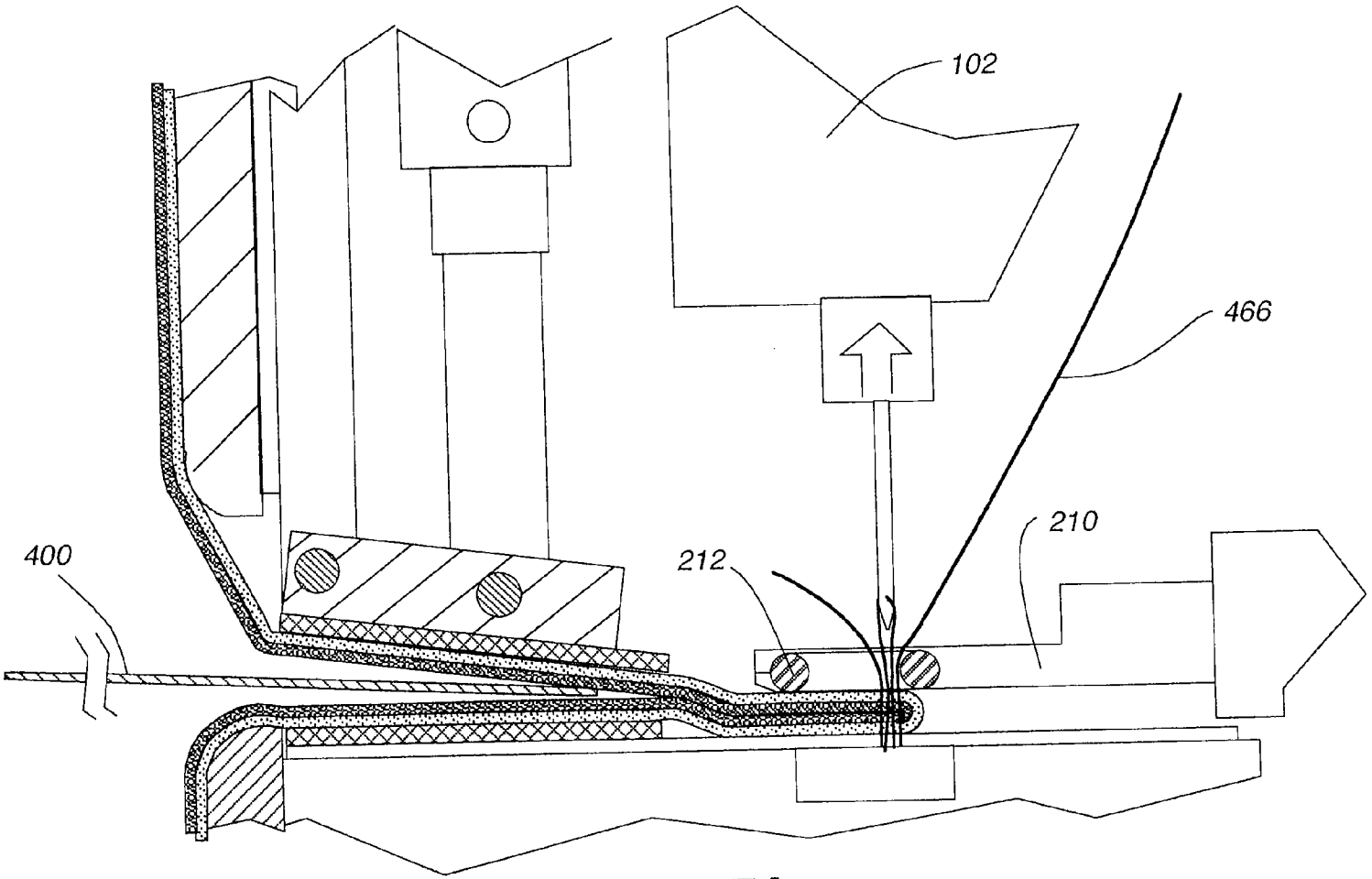
FIG. 7A is a close-up sectional view of the ring attachment station, with a plurality of stitches having been sewn inside the ring, for the apparatus shown in FIG. 1.
Figure 7B:
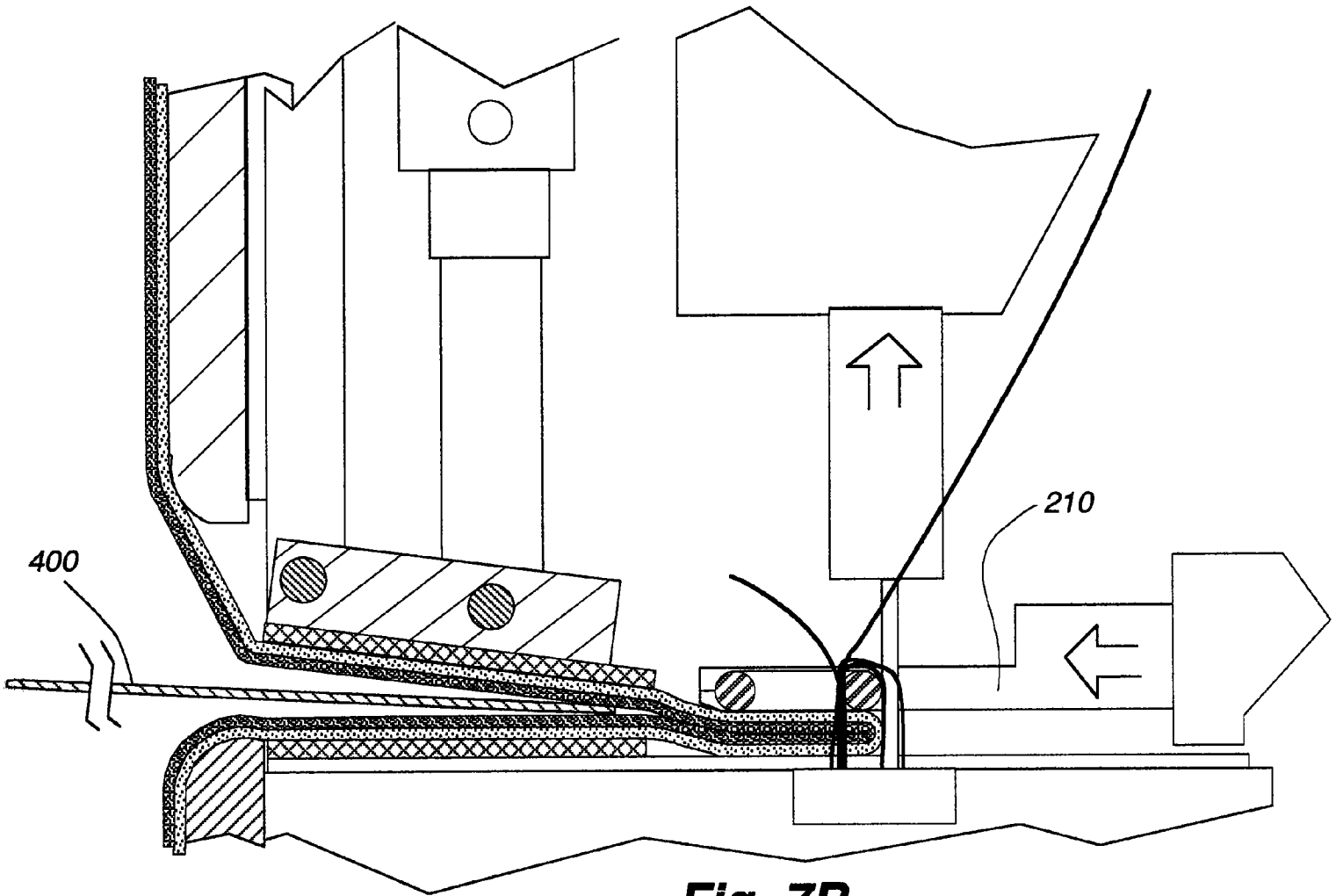
FIG. 7B is a close-up sectional view of the ring attachment station, with a plurality of stitches having been sewn outside the ring, for the apparatus shown in FIG. 1.

As shown in FIG. 5, upon the fold 470 being created in the fabric 306, the first sewing machine positions a ring 212 above the fabric in a position proximate to the fold location such that upon being stitched to the fabric, the ring will extend from the fabric at approximately the fold position. Upon the ring 212 being positioned on the top segment 468 of the fabric 306, the first sewing machine commences attaching the ring to the fabric by sewing one of a plurality of stitches inside the ring (as shown in FIG. 7). Once the desired number of stitches have been applied inside the ring, the first sewing machine 102 then repositions the ring (as shown in FIG. 7B) such that a plurality of stitches can be applied outside the ring and thereby secure the ring 212 to the fabric 306. The positioning, stitching, repositioning and continued stitching of the ring is accomplished using standard button attachment routines provided by the Juki sewing machine that have been modified to accommodate a ring instead of a two hole button.

Figure 7C:
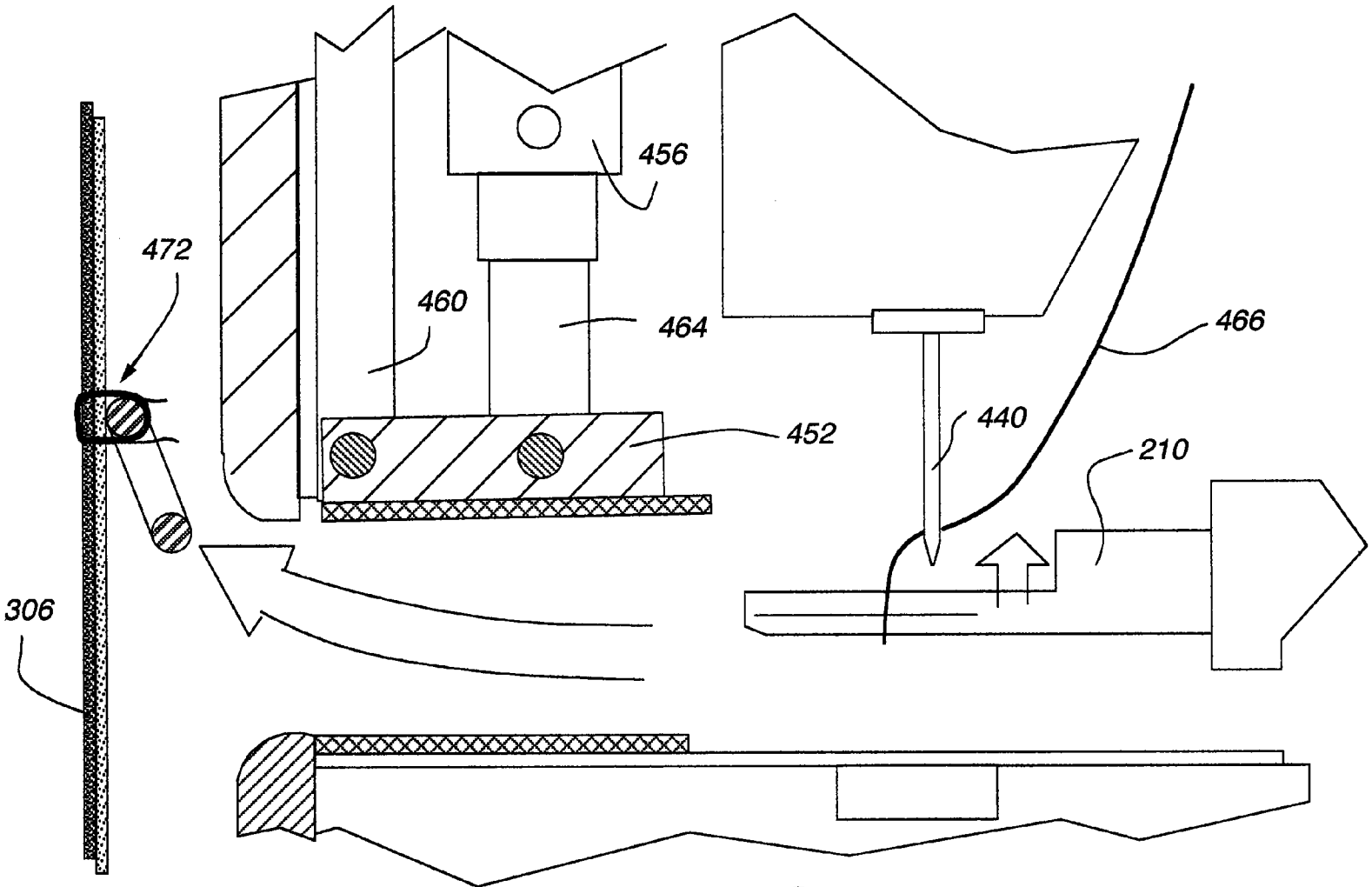
FIG. 7C is a close-up sectional view of the ring attachment station, after a predetermined number of rings, for a given span of fabric, have been attached to the fabric and the horizontal clamp released and withdrawn so that the fabric can clear, with rings attached, the ring attachment station, for the apparatus shown in FIG. 1.
Figure 7D:
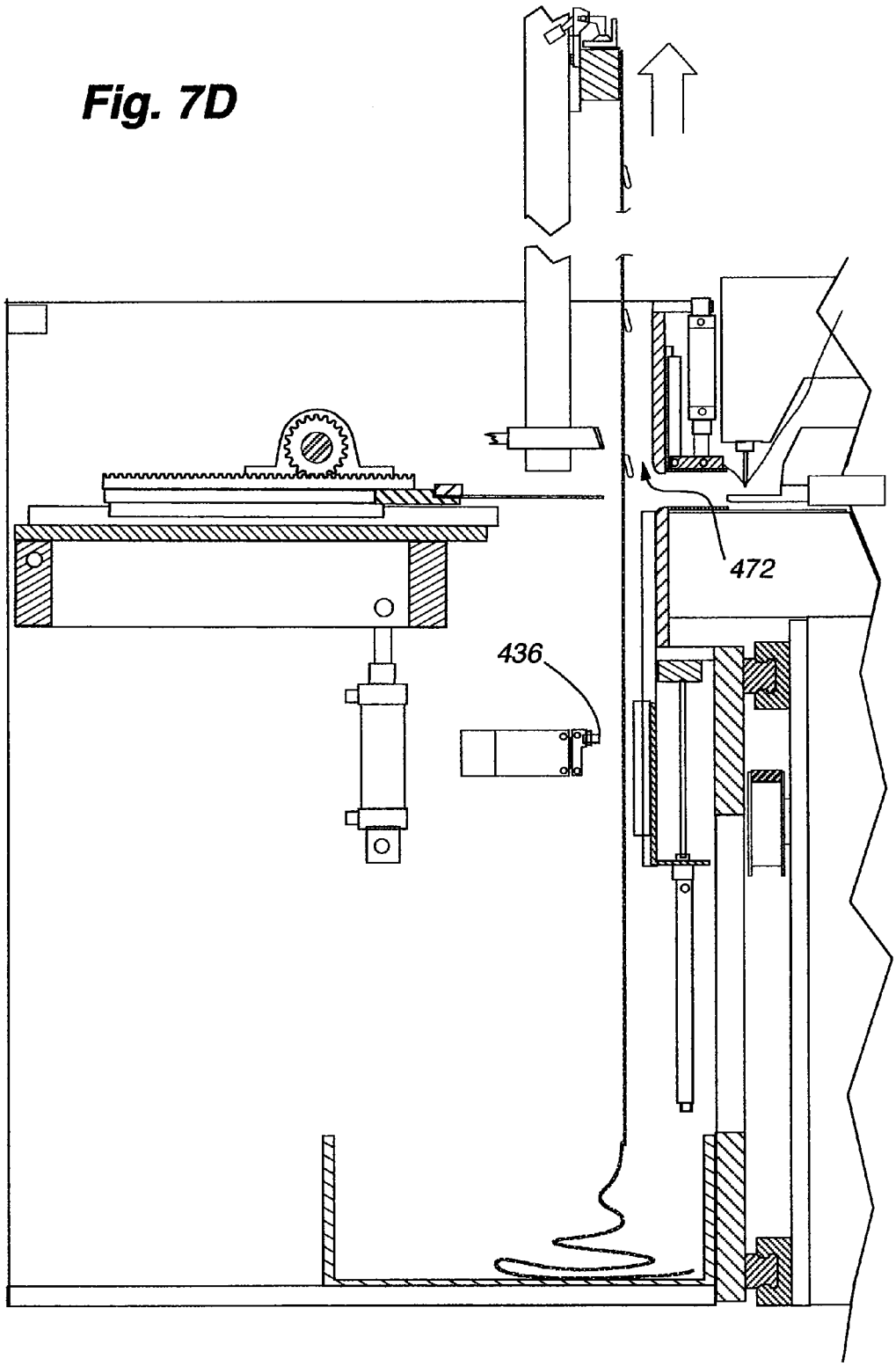
FIG. 7D is a cross-sectional view taken along line 4A of FIG. 3B which shows the ring attachment station of the apparatus of FIG. 1, after a row of rings have been attached to the fabric, the clamps released and the tucker blade withdrawn.

Once the desired number of rings for a given row have been attached to the fabric (and assuming no further stitching is desired), the ring tongs 208 and 210 (as shown in FIGS. 2B and 7C) are retracted, the needle 440 is raised, the thread 466 is cut, the downward pressure exerted by pressure plate 452 is released, the horizontal pressure exerted by vertical clamp 436 is released, and the fabric is allowed to return to a non-tucked, non-impinged position 472, as shown in FIGS. 7C and 7D. Desirably, the rod 464, vertical member 460, horizontal clamp 450 and pressure plate 452 are retracted such that a clearance region 474 is formed which enables the folded fabric to resume a vertical position without being impeded by the horizontal clamp 450.

Figure 8:
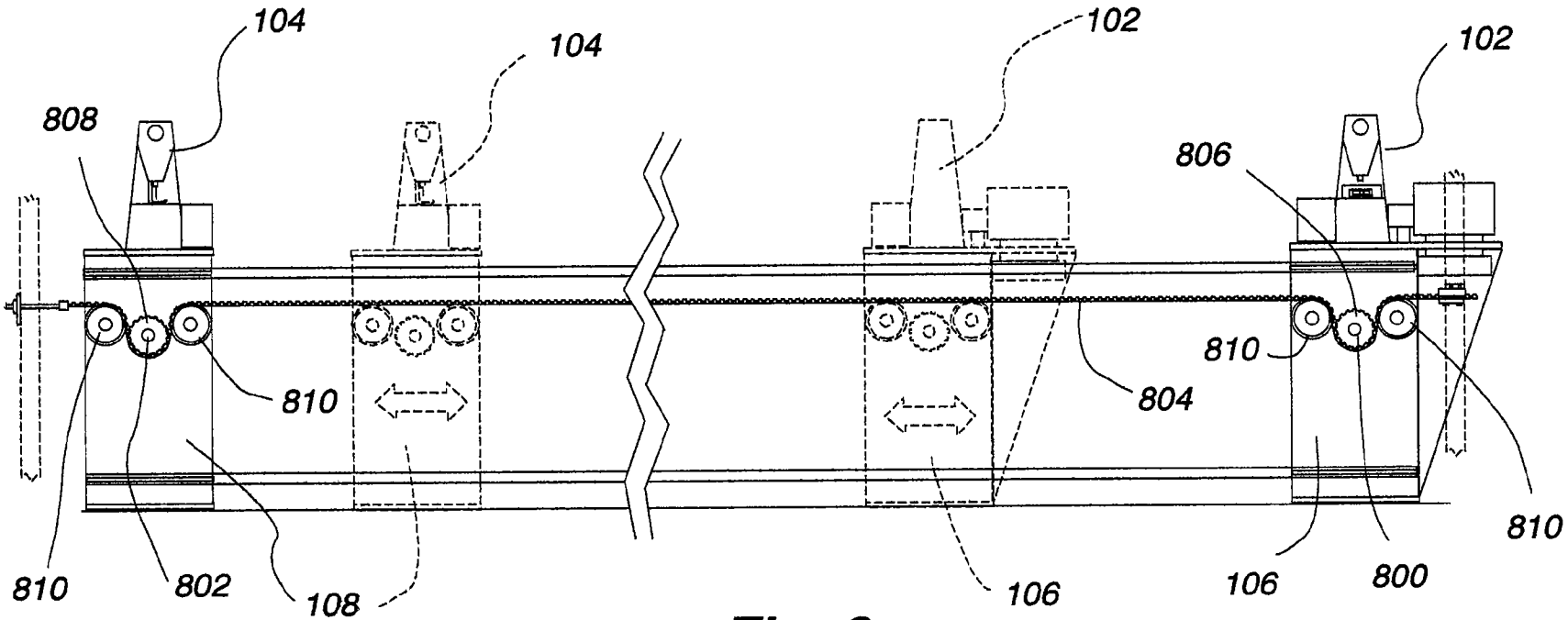
FIG. 8 is a rear dissected view showing of the apparatus shown in FIG. 1 identifying the timing belt drive mechanism used to relocate the ring attachment station and the tunnel stitching station.

Referring now to FIG. 8, the drive mechanism for each of the sewing machines is shown. In the embodiment of FIG. 1, each of the sewing machines 102 and 104 is secured to a sewing housing 106 and 108, respectively, that can travel along the span of the fabric, as desired. In one embodiment, the travel of each of the housings is controlled by using respective stepper motors (whose shafts 800 and 802 are shown in FIG. 8). A timing belt 804 is connected via respective timing gears 806 and 808 to the motors. Additionally, a plurality of corresponding idler pulleys 808 are used to guide the timing belt around the timing gears 806 and 808.

Referring now to FIGS. 9A-9D, a method by which the apparatus shown in FIG. 1-8 can be utilized to sew rings, slouches, rings and tunnels and/or hobbled shades is shown. For this embodiment, the process begins with configuring the apparatus for the desired operations by, for example, hanging the fabric(s) on the lift bar (Operation 900). As discussed above, one or more sheets of fabric may hang from the lift bar and rings sewn thereon or otherwise stitched accordingly. The apparatus configurations can also be set by entering the dimensions of the fabric(s) (Operation 902). It is to be appreciated that the dimensions of the fabric(s) may be preset, sensed by the apparatus (for example, by using optical or other sensors configured to detect the presence of fabric along the operating span of the apparatus), entered by an operator, provided by other process equipment or otherwise provided. The configuration operations can also include determining the operations to be performed with respect to the fabric(s) (Operation 904). The operations to be performed can be preset, based upon operator input (using, for example, console 101 (FIG. 1)) or otherwise determined. Depending upon the configuration of the apparatus, operations may include, but are not limited to, attaching rings only to the fabric, attaching rings so as to form a slouched shade, attaching rings and creating tunnels, attaching rings, creating tunnels and providing for a hobbled effect (where a front fabric has more material between tunnel seams than a backing fabric) and others. Based upon these inputs, the apparatus, using a controller, such as a CJIM programmable logic controller manufactured by Omron in Schaumberg, Ill., USA, calculates the number of rings needed per row (when rings are to be attached). Similarly, the apparatus can be programmed to determine the spacing between rows of rings and/or seams, the amount of hobble desired, the depth of any tunnels created, the position of the ring relative to the tunnel (for example, the ring may be attached at the fold or inside of the fold) and other calculations. Thus, it is to be appreciated that the apparatus may include any desired level of automation and/or operator input. As the automation of the apparatus increases, the controller may be substituted with microprocessors, computers and other centralized and/or distributed control systems.

Referring again to FIG. 9A, once the operating parameters and initial configurations are set, the lift bar 116 is positioned such that the first row of rings, tunnels or the like to be sewn is properly aligned with the tucker blade 400 (Operation 906). More specifically, the controller sends output signals to the lift motor assembly 132 which accordingly raises and/or lowers the lift bar 116 such that the fabric is positioned so that rings can be attached and/or tunnels/hobbles stitched along the desired first row.

Upon the fabric 306 being positioned, the tensioning mechanism 422 vertically clamps the fabric 306 to the linear bearing 430 by activating actuator 438, which extends vertical clamp 436 and applies pressure to the fabric 306 (Operation 908). At this point, the tension in and along the fabric extending from the lift bar 116 to the vertical clamp 436 is desirably uniform and constant.

A determination is also made as to whether the shade type is to be hobbled (Operation 909). It is to be appreciated that this operation (as can many if not most of the other operations shown in FIGS. 9A-9D) can be made prior to, after or in conjunction with any of the preceding operations and is shown as residing at Operation 909 for purposes of illustration and simplification only. If a hobbled shade is to be produced, the Operations proceed to Operation 960 of FIG. 9C.

Figure 9A:
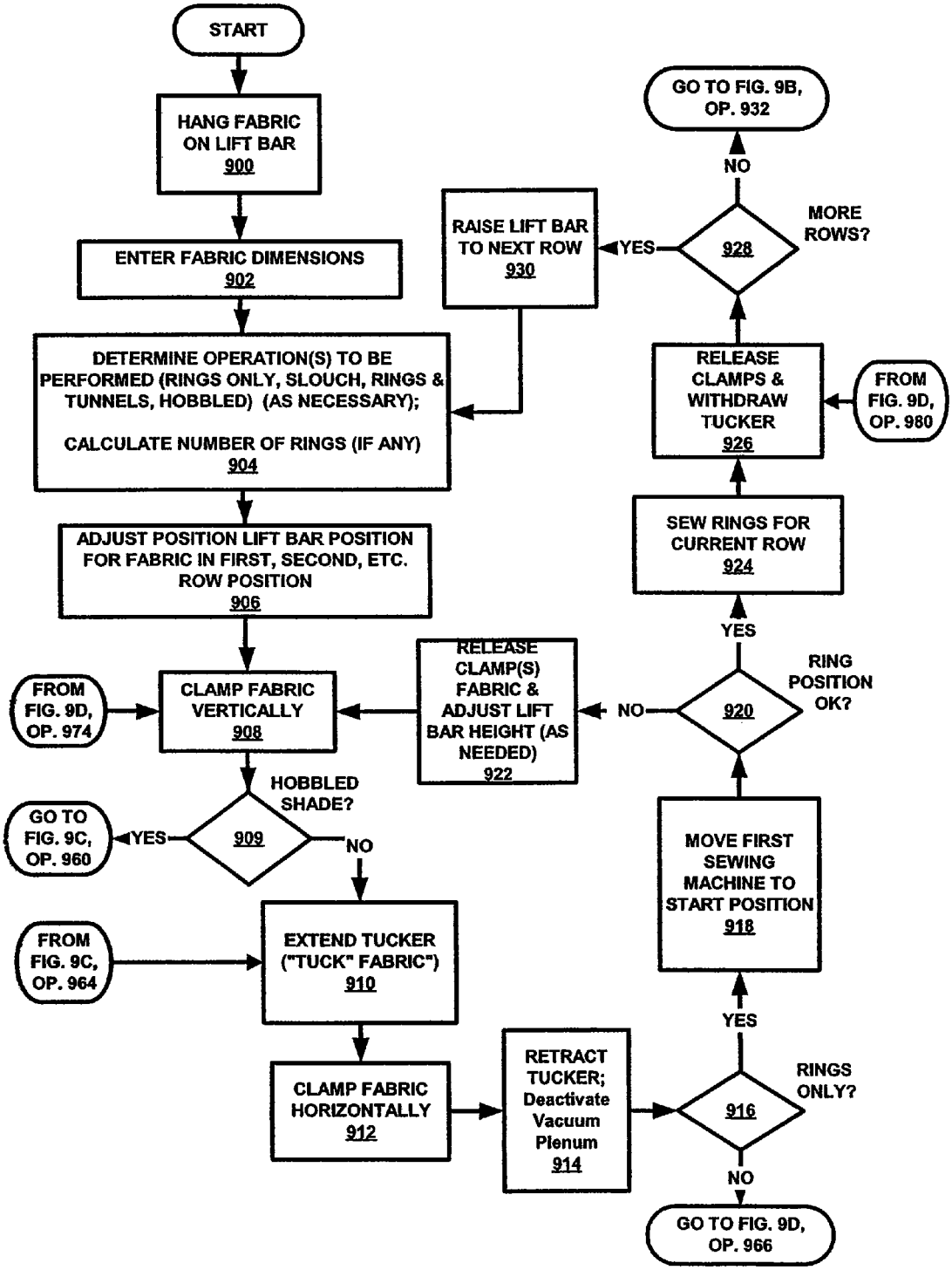
FIGS. 9A-9D are a flow chart illustrating a process flow for attaching and stitching fabric with rings only, rings with a slouch, rings with tunnels and rings with a hobbled fabric effect for one embodiment of the present invention.
Figure 9B:
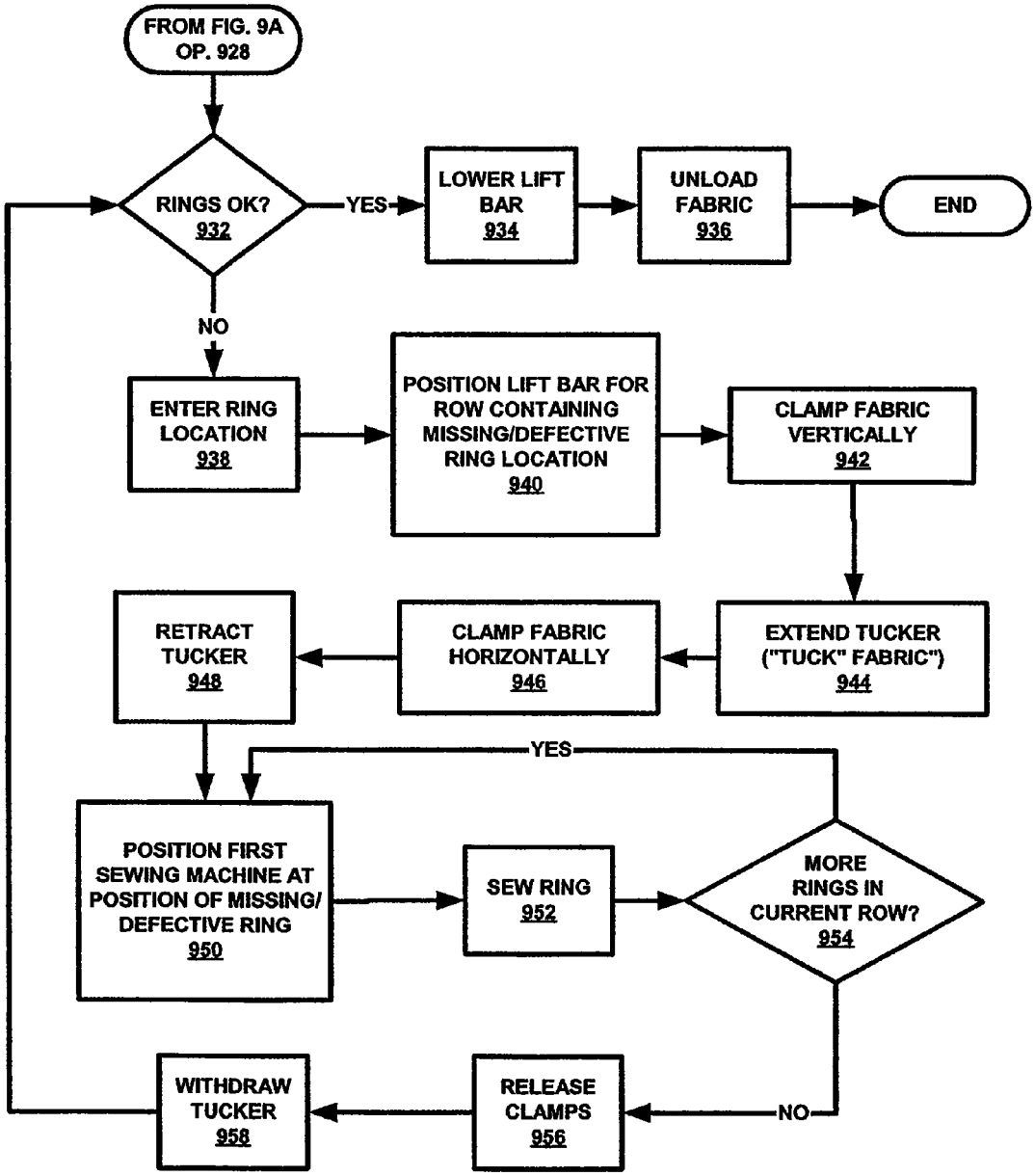
Figure 9C:
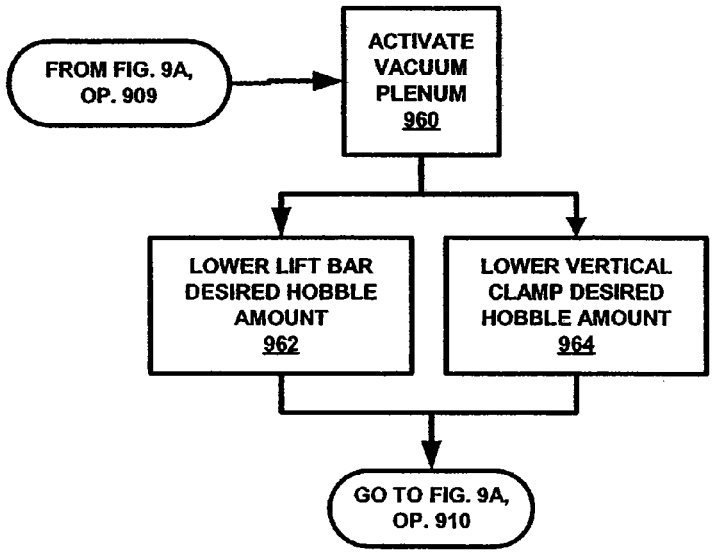
Figure 9D:
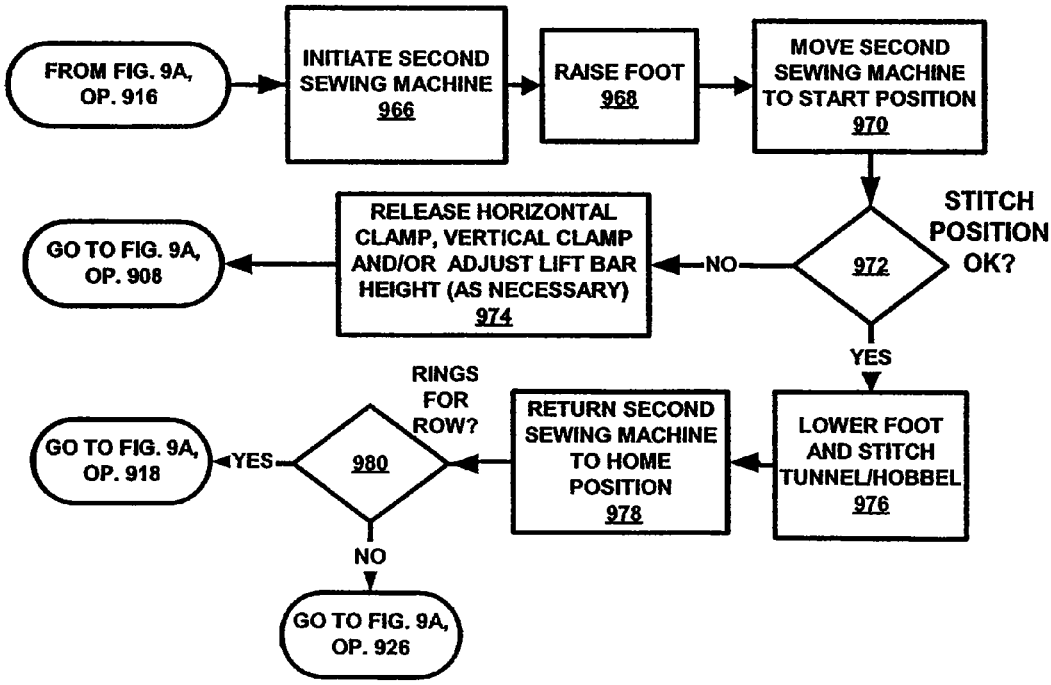

As shown in FIG. 9C and as discussed above, to produce a hobbled shade, the apparatus desirably allows more material to exist between the seams for one or more front sheet(s) than exist between the same seams with respect to one or more backing sheets. Simply stated, one may consider the front sheet(s) to be bunched between seams, whereas the backing sheet(s) are non-bunched. To facilitate this bunching of front sheets, the apparatus desirably uses a vacuum plenum 442 which draws the front sheet(s) towards it while allowing the backing sheet(s) to hang free (as shown in FIG. 4E) (or vice versa when an inverted hobbled shade is desired). It is to be further appreciated that since the backing sheets are secured by the tensioning mechanism 422 (FIG. 4B), which include vertical clamp 436, the amount of bunching possible with the apparatus is limited by the length of connecting rod 426. That is, as lift bar 116 and connecting rod 426 are lowered, the bunching of the first fabric 416 increases. Thus, when producing a hobbled shade, the process includes activating the vacuum plenum (Operation 960), lowering the lift bar 116 the desired hobble amount (Operation 962) and, correspondingly, and lowering the vertical clamp 436 (by extending connecting rod 426) the desired amount (Operation 964). As shown in FIG. 9C, Operations 962 and 964 desirably occur in conjunction and are each extended the same amount. It is to be appreciated, however, that the lift bar 116 may be lowered prior to the vertical clamp and that the lift bar may be lowered more than the vertical clamp, thereby also producing some bunching in any backing sheets. The process then resumes with Operation 910.

In Operation 910, the tucker blade 400 is extended as shown, for example, in FIG. 4C. Upon extension of the tucker blade 400, the "V" fold 418 in the fabric 306 is formed. Next, the horizontal clamp 450 and attached pressure plate 452 are extended such that the fabric is clamped horizontally (Operation 912). The tucker blade 400 is retracted (Operation 914). It is to be appreciated, however, that the tucker blade 400 may be retracted as the pressure from horizontal clamp 450 increases on the "V" part of the fabric. Thus, while shown as sequential Operations in FIG. 9A, it is to be appreciated that Operations 912 and 914 may occur substantially simultaneously or sequentially.

As discussed above, the apparatus desirably is capable of both attaching rings to the fabric as well as sewing tunnels and hobbles. In one embodiment, tunnels and hobbles are sewn before rings. In other embodiments rings are sewn first, then tunnels or hobbles. In other embodiments the sewing of rings and tunnels/hobbles may be interspersed, if so desired. In FIG. 9A, an embodiment of a process for automated shade manufacturing is shown in which tunnels and hobbles are sewn prior to the attachment of rings. In this embodiment, when tunnels and/or hobbles are to be sewn, the process continues with initiating the second sewing machine 104 (Operation 966, FIG. 9D).

Desirably, each of the sewing machines 102 and 104 are automatically operated under the control of the controller and are initiated for operation as needed. Once initiated, the foot of the second sewing machine is raised by a pneumatic cylinder or solenoid (Operation 968). It is to be appreciated that the pneumatic cylinder used to raise the foot of the sewing machines, and thereby perform a "toe" operation, may also be utilized to lower the foot of the sewing machines, and thereby perform "heel" operations. The performance of both "heel" and "toe" operations are common to sewing machines. The second sewing machine is moved to a start position, where the start position is the location along the fabric at which the stitching of the tunnel/hobble is to commence (Operation 970). A pause in the process can then occur. This pause enables an operator to verify that the fabric, the hobble (if any) and the second sewing machine are correctly configured and positioned before the stitching by the second machine commences (Operation 972).

If the fabric, second sewing machine, hobble or the like is not correctly positioned or formed (in the case of a hobble), the process continues taking those actions necessary to resolve the error condition. Such actions may include releasing the horizontal clamp, releasing the vertical clamp, deactivating and reactivating the vacuum plenum, raising and lowering the lift bar, and the like. Such actions may be pre-programmed, or operator directed via the control console. For purposes of illustration, the process flow of FIGS. 9A-9D illustrate the process resuming with the clamping of the fabric vertically, in Operation 908. It is to be appreciated, however, that the process may resume at any of Operations 910, 912, 914 916, 966, 968, 970, 972 or otherwise.

When the fabric is correctly positioned on the apparatus, the stitching of a seam, whether for a tunnel or a hobble, resumes with lowering the foot and stitching the tunnel/hobble (Operation 976). The stitching of the tunnel/hobble desirably occurs across the entire width of the fabric, at which instance the second sewing machine is returned to its home position (Operation 978). The controller also determines whether rings are to be attached to the fabric along the current row (Operation 980). If not, then the process continues at Operation 926 with releasing both the vertical clamp and the horizontal clamp, withdrawing the tucker blade 400 and determining whether additional rings are to stitched. Such rows may include rings, tunnels, hobbles or the like.

When rings are to be attached to the fabric along a currently clamped row of fabric (regardless of whether a tunnel or hobble has or has not been stitched), the process proceeds with moving the first sewing machine 102 to a start (or first ring) position (Operation 918). The controller, if it has not already done so or otherwise been instructed, calculates the number of rings to be attached for the given row and the location of the rings. At this instance, the process desirably pauses and allows time for the operator to verify that the first ring position is correct (Operation 920). If the first ring position is not correct, the process desirably proceeds with releasing either or both the horizontal clamp and the vertical clamp, withdrawing the tucker, adjusting the lift bar height, repositioning the first sewing machine, recalibrating the ring offset, specifying the number of rings to be attached for the given row, or the like (Operation 922). Desirably, reorientation of the fabric and reconfiguration of the apparatus is not necessary when a tunnel or hobble has already been stitched for a given row.

When the first ring position is correct, the process continues with the first sewing machine automatically attaching the first ring and all subsequent rings for the row. (Operation 924) In the embodiment shown in FIG. 1, the first sewing machine is repositioned under the direction of the controller to each of the ring sewing positions along the width of the fabric by instructing the stepper motor for the first sewing machine to rotate the timing gear 806 a desired number of counts and thereby move the first sewing machine to the next ring position.

Upon sewing all of the rings for a given row, the process continues with releasing the clamps and withdrawing the tucker blade (Operation 926). If more rows remain for which tunnels/hobbles need to be stitched and/or rings attached, the process continues at Operation 930 with raising the lift bar to the next row and repeating the above described steps. As shown, Operation 930 is shown as proceeding to Operation 904, where a determination of whether rings, slouch, tunnels and/or hobbles can again be made, as necessary or desired. That is, the apparatus can be configured to sew, for example, tunnels on any given number of rows, such as every other row or the like. Also, the apparatus can be configured to sew every row the same. If so, then it should be appreciated that Operation 904 may be bypassed and the sewing of the next row resuming, after Operation 930 with Operation 906 or 908.

When no more rows are to be sewed to the fabric, the process continues from Operation 928 with Operation 932 (FIG. 9B). As shown in Operation 932, the process desirably includes another pause. During this pause, the operator may raise and lower the fabric and visually inspect whether any rings are missing or defectively sewn for a given row. If not, the process desirably continues with lowering the lift bar (Operation 934), releasing the top clamp and unloading the fabric (Operation 936). At this point the process ends.

Alternatively, if the rings are not okay, the process continues with the operator instructing the apparatus to position the lift bar so that a ring can be attached to the row containing the missing or defective ring (Operation 940). If a ring is defective, the operator can remove it. Once the lift bar is positioned at the desired height, the process continues with the removal of the defective ring (if any), vertically clamping the fabric (Operation 942), extending the tucker blade so as to form the "V" shape in the fabric (Operation 944), horizontally clamping the fabric (Operation 946), retracting the tucker blade (Operation 948) and positioning the first sewing machine at the position of the missing/defective ring (Operation 950). A new ring is then sewn onto the fabric (Operation 952). A determination can then be made as to whether any additional rings are missing or defective for a given row (Operation 954). If so, the remaining rings are attached to the row per Operations 950 and 952. If no more rings are to be sewn for the current row, the clamps are released (Operation 956), the tucker blade withdrawn (Operation 958) and a determination made as to whether any other rows are missing rings or contain defective rings. If so, the above process continue. If not, the lift bar is lowered (Operation 934), the top clamp 118 is released, the fabric is unloaded from the apparatus (Operation 936) and the process ends.

Although various embodiments of the apparatus and method for automated shade manufacturing have been described above, those skilled in the art can make numerous alterations to the disclosed embodiments without departing from the spirit or scope of the disclosed inventions. Further, all references (e.g., first, second, up, down, inner, outer, above, below, clockwise, counterclockwise, next, then, continuing, or the like) used above are to aid the reader's understanding of the disclosed inventions, but, are not to be construed as creating or establishing any limitation as to the features, functions, components, parts, process operations, orientation, configuration or the like of the present inventions. It is intended that all matter contained in the above description and drawing figures are for purposes of illustration and explanation only and are not to be construed as limiting the scope of any claimed inventions.

The invention claimed is:

1. The combination of a fabric and an apparatus for stitching and/or attaching rings to the fabric comprising in combination:

a vertically adjustable lift bar to which said fabric can be attached and suspended substantially vertically, a housing including a lower clamp for releasably securing a portion of said fabric beneath said lift bar, a generally horizontally reciprocable tucker blade for selectively engaging and forming a tuck in said fabric when said tucker blade is extended, a second clamp for releasably gripping said tuck in said fabric, and first and second individually movable and operable sewing machines mounted on said housing for traversing movement across the width of said fabric, with said first sewing machine for stitching said tuck and said second sewing machine designed for attaching rings to said tucks.

2. The combination of claim 1 further including a vacuum chamber in said housing for selectively gathering at least a portion of said fabric.

3. The combination of claim 2 wherein said fabric includes two panels and only one of said panels is gathered in said chamber when tucks are formed in said fabric.

4. The combination of claim 1 wherein said tucker blade is selectively removed from said second clamp when said second clamp is releasably gripping said fabric.

* * * * *